US005583309A

United States Patent [19]

Fujita

[11] Patent Number: 5,583,309

[45] Date of Patent: Dec. 10, 1996

[54] FILTER APPARATUS FOR AN ELECTRONIC MUSICAL INSTRUMENT

[75] Inventor: Yoshio Fujita, Hamamatsu, Japan

[73] Assignee: Yamaha Corporation, Japan

[21] Appl. No.: 131,856

[22] Filed: Oct. 5, 1993

Related U.S. Application Data

[63] Continuation of Ser. No. 591,727, Oct. 2, 1990, abandoned.

[30] Foreign Application Priority Data

Oct. 4, 1989 [JP] Japan ..... 1-259739

[51] Int. Cl.[6] ..... G10H 1/12

[52] U.S. Cl. ..... 84/622; 84/661; 84/736

[58] Field of Search ..... 84/DIG. 9, DIG. 26, 84/622–625, 654–661, 735, 736

[56] References Cited

U.S. PATENT DOCUMENTS

| | | | |
|---|---|---|---|
| 3,830,952 | 8/1974 | Kitchen | 84/701 |
| 4,308,779 | 1/1982 | Suzuki et al. | 84/687 |
| 4,442,745 | 4/1984 | Gross et al. | 84/607 |
| 4,472,993 | 9/1984 | Futamase et al. | 84/DIG. 26 |
| 4,554,857 | 11/1985 | Nishimoto | 84/624 |
| 4,558,624 | 12/1985 | Tomisawa et al. | 84/626 |
| 4,633,749 | 1/1987 | Fujimori et al. | 84/607 |
| 4,658,690 | 4/1987 | Aitken et al. | 84/DIG. 30 |
| 4,736,663 | 4/1988 | Wawrzynek et al. | 84/DIG. 9 |
| 4,813,328 | 3/1989 | Takouji | 84/DIG. 9 |
| 4,843,938 | 7/1989 | Hideo | 84/DIG. 9 |
| 4,907,484 | 3/1990 | Suzuki et al. | 84/661 |
| 4,998,281 | 3/1991 | Sakata | 84/630 X |
| 5,033,352 | 7/1991 | Kellogg et al. | 84/658 |
| 5,137,567 | 12/1992 | Fujita | 84/661 X |
| 5,149,902 | 9/1992 | Washiyama | 84/622 |
| 5,380,950 | 1/1995 | Kunimoto | 84/661 |

FOREIGN PATENT DOCUMENTS

| | | | |
|---|---|---|---|
| 52-34092 | 8/1977 | Japan | G10H 1/02 |

*Primary Examiner*—Brian Sircus
*Attorney, Agent, or Firm*—Graham & James LLP

[57] ABSTRACT

A musical tone generating apparatus is provided for a keyboard electronic musical instrument. The apparatus consists of a musical tone source, a coefficient generator, a digital filter and so on. The coefficient generator generates at least one time dependence coefficient, and applies It to output of the digital filter. The parameter controller changes at least one parameter, which designates tone color of the musical tone, in accordance with the time dependent coefficient to thereby realize time-variant changing rate of envelope of musical tone. And, the coefficient generator and the parameter controller are used by means of time sharing technique. That is, the coefficient is used as plural units, wherein each unit generates a coefficient in each stage, and the digital filter is also used as plural units. Each digital filter unit changes a parameter of tone color of the musical tone in accordance with the coefficient supplied thereto.

16 Claims, 14 Drawing Sheets

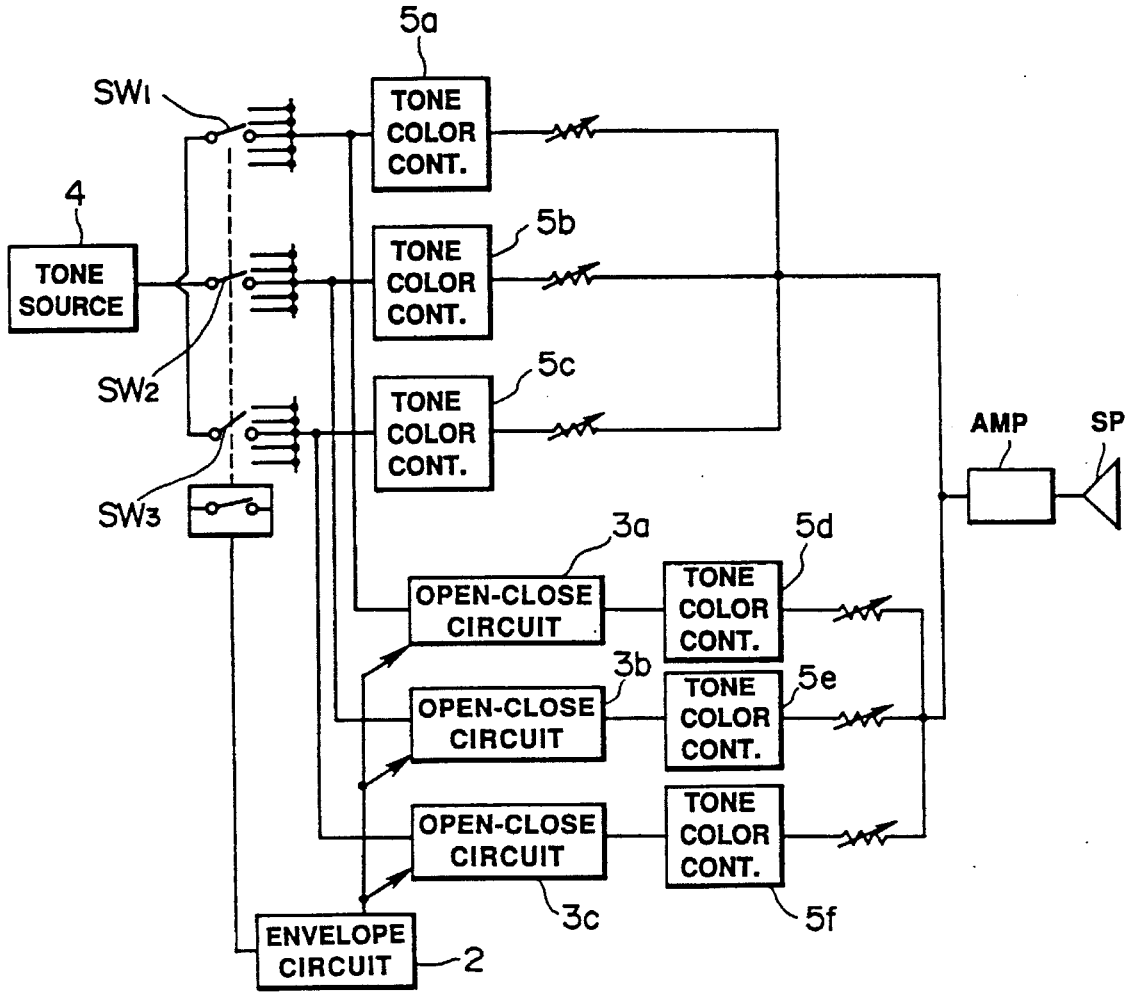
FIG.14 *(Prior Art)*
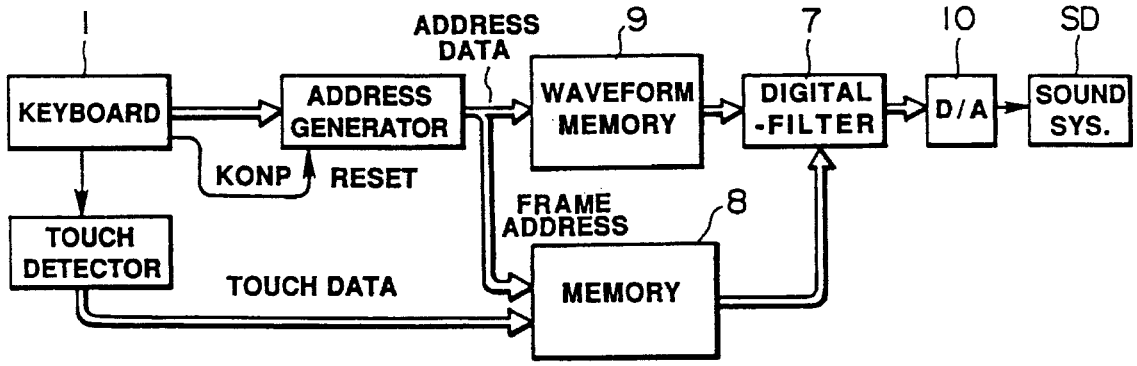
FIG.15 *(Prior Art)*

FILTER APPARATUS FOR AN ELECTRONIC MUSICAL INSTRUMENT

This is a continuation of application Ser. No. 07/591,727 filed on Oct. 2, 1990, now abandoned.

BACKGROUND OF THE INVENTION

1. Field of the Invention

The present invention relates to a filter apparatus for an electronic musical instrument, which generates various musical tone waveforms.

2. Prior Art

Conventionally, as electronic musical instrument generates musical tones having characteristics of acoustic musical tone, such that the tone color of the musical tone is altered by a filter which has a variable frequency characteristic. The first conventional musical tone generating apparatus is disclosed in Japanese Utility model laid-Open Publication No. Sho52-34092 shown in FIG. 14. In FIG. 14, the musical tones from tone source 4 are supplied to tone color controllers 5*a*, 5*b* and 5*c*, and open-close circuits 3*a*, 3*b* and 3*c* through key-switch SW1, SW2 and SW3. Each tone color controller 5*a*, 5*b* and 5*c* adds tone color parameters to each musical tone which is inputted therein, and outputs each musical tone to amplifier AMP, as a first musical tone. Each open-close circuit 3*a*, 3*b* and 3*c* outputs the musical tone which is inputted therein, to tone color controllers 5*d*, 5*e* and 5*f* according to the envelope from envelope circuit 2. Each tone color controller 5*d*, 5*e* and 5*f* adds tone color parameters to each musical tone which is inputted therein, and outputs each musical tone to the amplifier AMP, as a second musical tone. In the amplifier AMP, the first musical tone and the second musical tone are mixed, and then the mixed musical tone is outputted from speak SP as musical sound.

However, in the above-mentioned conventional apparatus shown in FIG. 14, while it is possible to change the frequency characteristic of the tone color controllers 5*a*, 5*b*, 5*c*, 5*d*, 5*e*, it is impossible to control a rate of change the envelope in accordance with a state of the touch information (key-on velocity, key-off velocity and so on) of the keyboard 1.

Hence, in this first conventional apparatus, only a musical tone having simple tone color is obtained.

Next, the second conventional musical tone generating apparatus is disclosed in U.S. Pat. No. 4,843,938 shown in FIG. 15. In FIG. 15, plural filter parameters which designate frequency characteristic of a digital-filter 7, which is used as a tone color controller, are memorized in a memory 8, and are supplied to the digital-filter 7 according to touch information from a keyboard 1, in each fixed interval (frame). Therefore, a musical tone from a waveform memory 9 is filtered by the digital-filter 7 having frequency characteristic which changes with elapsed time. As a result, the envelope of the musical tone changes variably in accordance with frequency characteristics. This musical tone is supplied to the D/A converter 10, and outputted as musical sound by sound system SD.

In the apparatus shown in FIG. 15, if it is desired to change the rate of change of the frequency characteristic of the digital-filter, the apparatus must be expanded such that it would be necessary to provide a means which changes the outputting velocity of the filter parameter, or to provide a larger memory in which plural filter parameters designating various changes of performance information are memorized.

SUMMARY OF THE INVENTION

Accordingly, it is a purpose of the present invention to provide a musical tone generating apparatus which changes at least the parameters which characterize tone color of the musical tone, with a time dependent coefficient. In an aspect of the present invention, there is provided a filter apparatus for an electronic musical instrument comprising:

(a) musical tone source means for generating musical tone according to operation of a performer;

(b) coefficient generator means for generating an elapsed time coefficient; and (c) parameter control means for changing at least one parameter which characterizes tone color of said musical tone, in accordance with said elapse time coefficient.

As a result, according to the present invention, it is possible to obtain the musical tone without expanding and complicating the apparatus. In addition, it is possible to obtain a musical tone having great variety whose tone color can be varied smoothly.

BRIEF DESCRIPTION OF THE DRAWINGS

Further objects and advantages of the present invention will be apparent from the following description, reference being made to the accompanying drawings wherein a preferred embodiment of the present invention is clearly shown.

In the drawings:

FIG. 14 is a block diagram showing a first conventional apparatus;

FIG. 15 is a block diagram showing a second conventional apparatus.

DETAILED DESCRIPTION OF THE PREFERRED EMBODIMENT

A. Configuration of the Embodiment

Figure 1:
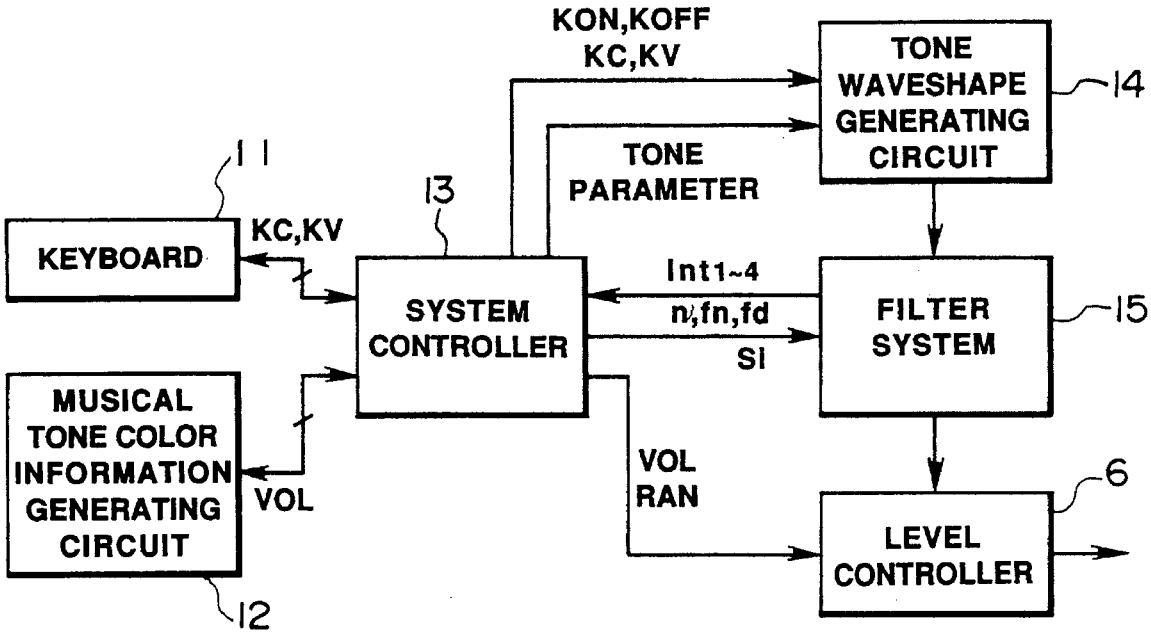
FIG. 1 is a block diagram showing an electric configuration of an electric musical instrument which adopts a filter apparatus for an electronic musical instrument according to an embodiment of the present invention.

FIG. 1 is a block diagram showing the electric configuration of the musical tone synthesizing apparatus according to the present invention. In FIG. 1, 11 designates a keyboard which transmit a keycode KC, a key-on signal KON, a key-off signal KOFF, a key-on velocity KV and a key-off velocity KOFFV, as information representative of the touching of the keyboard, to the system controller 13. In addition, a musical tone control information generating circuit 12 consisting of a plurality of manually operable members such as a volume portion, a pitch-bent portion and so on is shown. The musical tone control information generating circuit 12 generates tone information, in accordance with the detected operation of each of the manually operable members, to the system controller 13. The system controller 13 consists of a CPU (Central Processing Unit), a memory portion and associated circuitry which controls the musical tone synthesizing apparatus, in accordance with predetermined programs. The controller 13 outputs a keycode KC, a key-on signal KON, a key-off signal KOFF, a key-on velocity KV, key-off velocity KOFFV and tone color parameters, on the basis of the foregoing tone information, to a tone waveshape generating circuit 14. The system controller 13 also outputs the various tone designation information (a target cut-off frequency fd, a present cut-off frequency fn, an interpolation velocity Si, a filter designation number n and a reset signal IR of the filter system as mentioned later) to the filter system to alter the cut-off frequency f by means of time sharing. The system controller 13 also outputs the volume signal VOL to a level controller 6. The tone waveshape generating circuit 14 generates tone waveshape data on the basis of the above-mentioned keycode KC, the key-on velocity KV, the key-on KON, the key-off velocity KOFFV, the key-off KOFF and the tone color parameters, and outputs the tone waveshape data to the filter system 15. The filter system 15 is constructed as a multiple filter with time sharing, wherein the cut-off frequency f is changed from the present cut-off frequency fn to the target cut-off frequency fd with velocity information on the basis of the interpolation velocity Si when the above-mentioned present cut-off frequency fn and the target cut-off frequency fd are established by the system controller 13. Therefore, the tone waveshape data is filtered by the filter system 15. The filtered tone waveshape data is supplied to the level controller 6. The filter system 15 outputs interruption signals in accordance with each filter to the system controller 13. The level controller 6 generates a tone signal from the tone waveshape data according to the volume signal VOL.

Next, the filter system 15 will be described by referring to FIG. 2.

(1) Configuration of Filter System 15

Figure 2:
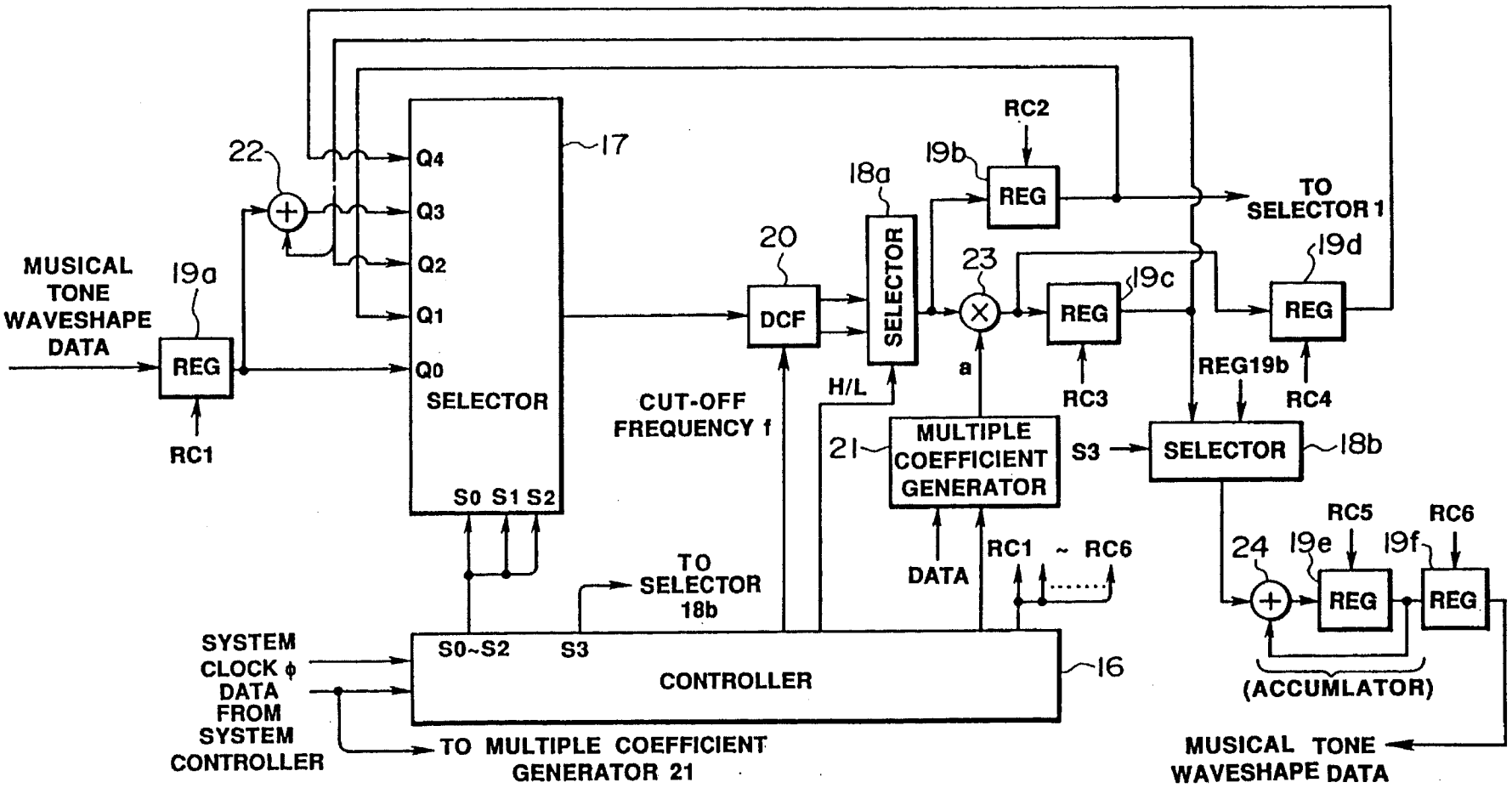
FIG. 2 is a block diagram showing an electric configuration of a filter system 15 shown in FIG. 1.
Figure 4A:
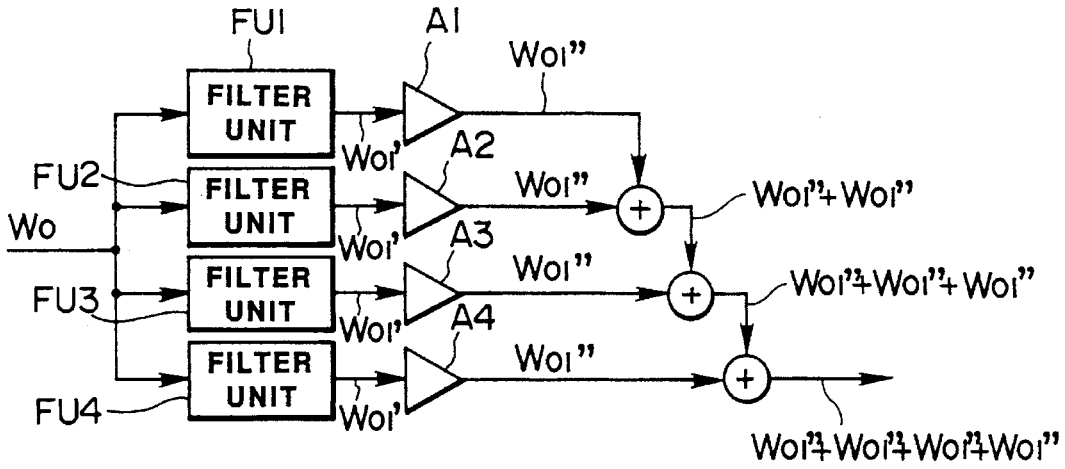
FIG. 4(*a*)–(*h*) are block diagrams showing filter flows which are constructions of filter system 15.
Figure 4B:
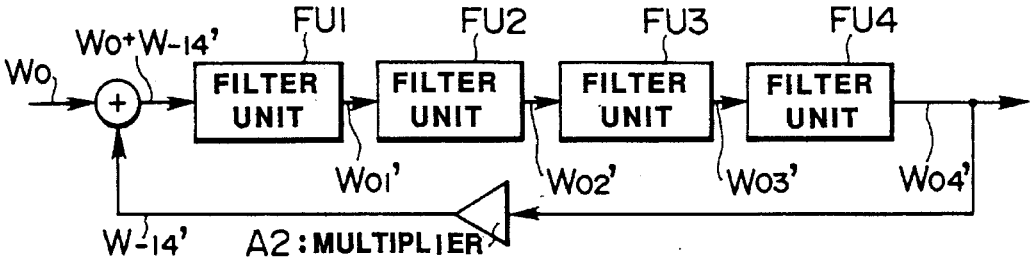
Figure 4C:
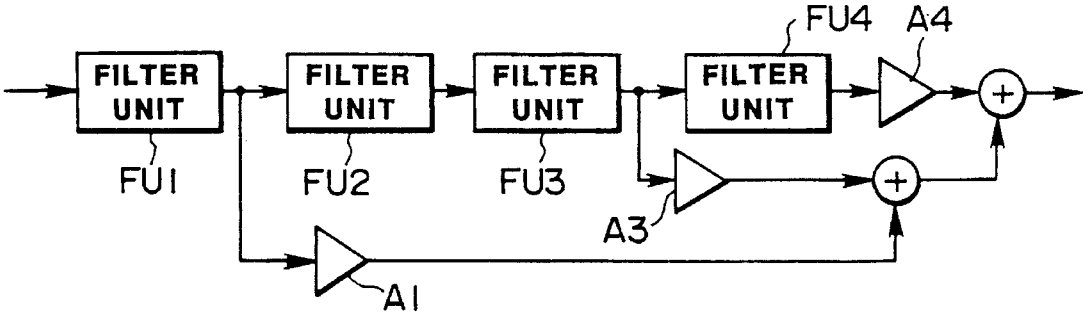
Figure 4D:
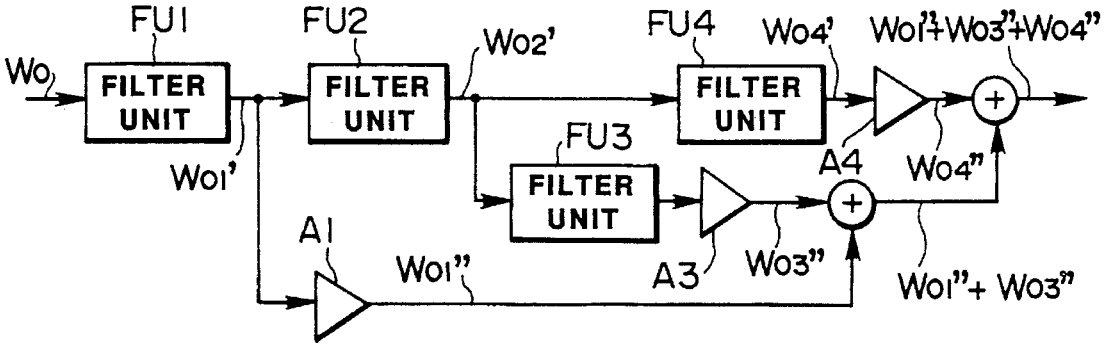
Figure 4E:
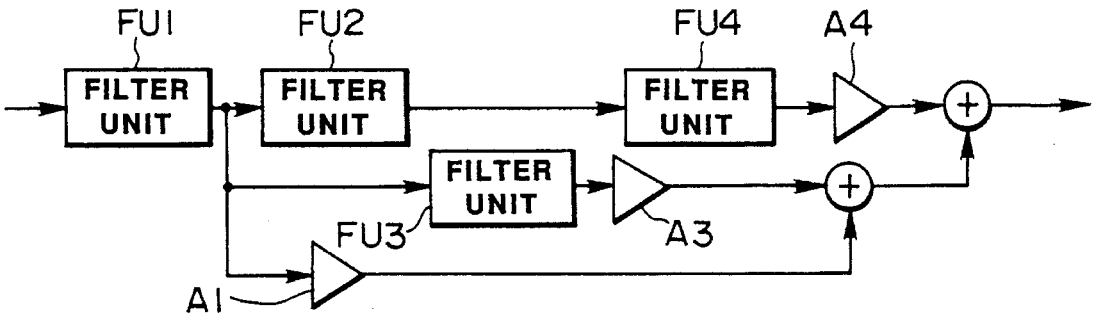
Figure 4F:
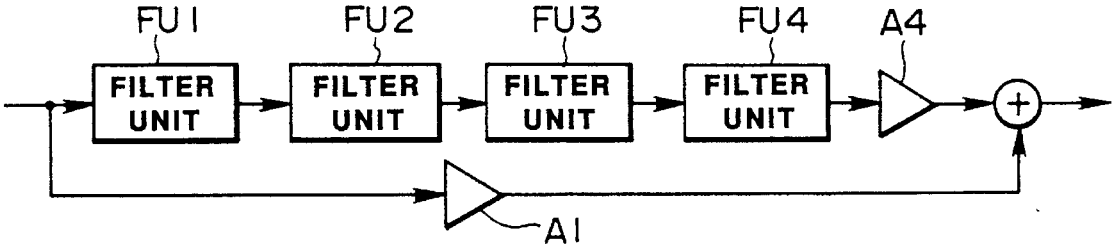
Figure 4G:
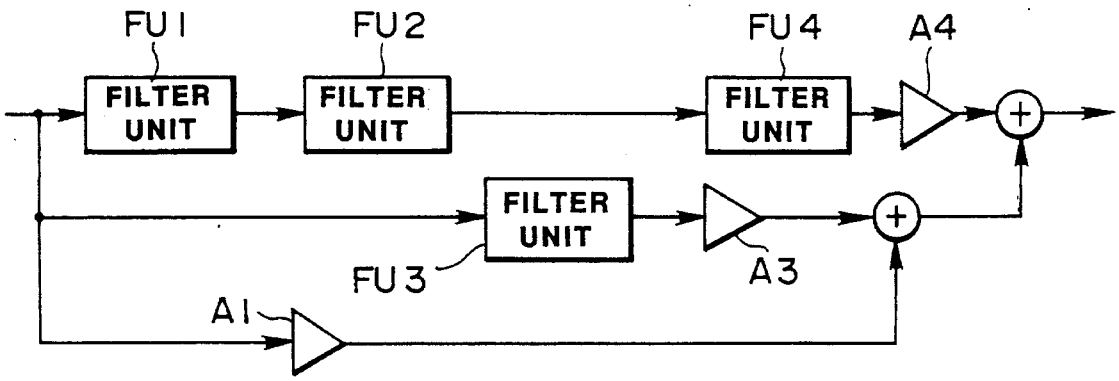
Figure 4H:
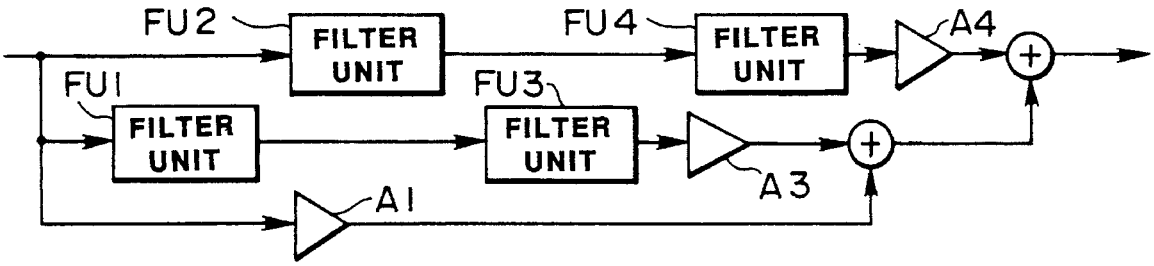

FIG. 2 is a block diagram showing the filter system 15. In FIG. 2, the filter system 15 consists of a controller 16, selectors 17, 18*a*, 18*b*, registers (REG) 19*a*, 19*b*, 19*c*, 19*d*, 19*e*, 19*f*, digital filter (DCT) 20 and multiple coefficient generator 21.

The controller 16 controls the working timing of each portion, and outputs various data to the above-mentioned portions. The controller 16 is supplied with the system clock ø and the mentioned above tone designation information. The controller 16 outputs signals S0, S1 and S2 to the selector 17, and also outputs control signals RC1–RC6 to each of the registers 19*a*–19*f*. Furthermore, the controller 16 outputs an H/L signal to the selector 18*a*, and outputs the cut-off frequency f to the DCF 20, respectively.

Next, REG 19*a* latches the tone waveshape data and outputs the latched tone waveshape data on the basis of the control signal RC1 to the input-terminal $Q_0$ of the selector 17 and the adder 22.

The selector 17 outputs data to DCF 20; which data consists of one of a plurality of data existing on terminals $Q_0$–$Q_4$ selectively, according to the state of signals S0, S1 and S2.

Figure 3:
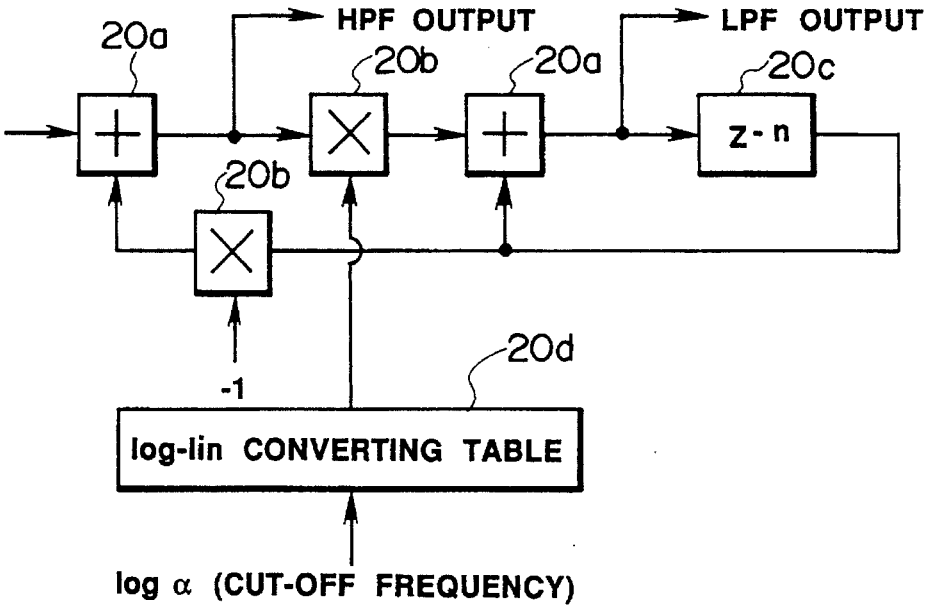
FIG. 3 is a block diagram showing an electric configuration of the DCF 20 shown in FIG. 2.

The DCF 20 consists of adders 20*a*, 20*a*, multipliers 20*b*, 20*b*, a delay circuit 20*c* and a log-linear converting table 20*d* as shown in FIG. 3. The cut-off frequency f of the DCF 20 is controlled by the parameter logα corresponding with logarithm value of the cut-off frequency f. And, the DCF 20 prepares two outputs as high-pass filter(HPF) and low-pass filter(LPF). Both outputs of the HPF and the LPF of DCF 20 are supplied to the selector 18*a*.

The selector 18*a* selects one of the tone waveshape data, which are supplied through the HPF, corresponding with H/L signal, and outputs the selected tone waveshape data to the multiplier 23 and the REG 19*b*.

The REG 19*b* latches the tone waveshape data, which is outputted from the DCF 20, corresponding to the control signal RC2. The tone waveshape data which is outputted from REG 19*b* is supplied to the input-terminal $Q_1$ of the selector 17 and the selector 18*b* on the basis of the tone designation information.

The multiple coefficient generator 21 generates multiple coefficients on the basis of the tone designation information, and outputs the multiple coefficients to the multiplier 23.

Next, the multiplier 23 multiplies the multiple coefficient by the tone waveshape data, and then controls the level of the tone waveshape data. The level-controlled tone waveshape data is supplied to the REG 19*c* and the REG 19*d*. The REG 19*c* latches the level-controlled tone waveshape data corresponding to the control signal RC3. The tone waveshape data from the REG 19 is supplied to the input-terminal $Q_2$ of selector 17, the selector 18*b* and the adder 22, respectively.

The adder 22 adds the tone waveshape data from the REG 19*a* and the tone waveshape data from the REG 19*c*, and then outputs the added result to the input-terminal $Q_3$ of the selector 17. The REG 19*d* temporarily stores the tone waveshape data from the multiplier 23 corresponding to the control signal RC4. The output of REG 19*d* is supplied to the input-terminal $Q_4$ of the selector 17.

Furthermore, the selector 18*b* outputs selectively an output data from the REG 19*b* or from the REG 19*c* to the adder 24. The output data of the adder 24 is supplied to the REG 19*e*. The REG 19*e* is an accumulator, and maintains temporarily the output data from the adder 24 corresponding to the control signal RC5. The output data of REG 19*e* is supplied to the REG 19*f* and the adder 24. That is, the adder 24 adds the output data of selector 18*b* and the output data of REG 19*e*. As a result, REG 19*e* maintains the added result of the output data from selector 18*b* and the value of REG 19*e*. The REG 19*f* is a filter flow outputting register, and maintains temporarily the final tone waveshape data from the filter system 15, and outputs it to the level controller 6.

Next, the filter flow of multiple formation which consists of the filter system 15 will be described.

1. Configuration of Filter Flow

In the filter system 15, each of the selectors 17, 18*a*, 18*b* and each of the REG 19*a*–19*f* is respectively controller by the select signal S0–S3 and the control signal RC1–RC6. As a result, for example, the filter system 15 forms at least one of the multiple filter flows as shown in FIG. 4(*a*)–(*h*).

Hereinafter, description will be given with respect to the detailed explanation of the multiple filter flows by referring to FIG. 4(*a*)–(*h*). DCF 20 performs the function of filter units FU1–FU4 shown in FIG. 4(*a*)–(*h*) by the means of the time sharing. The number of each filter unit FU1–FU4 designates the order of the time series. A1–A4 designate multipliers which control the level of the tone waveshape data through each signal path. The multiplier 23 performs the function of multipliers A1–A4 shown in FIG. 2 by means of time sharing in the same way as the DCF 20. A number of the multiples A1–A4 also designates the order of the time series. The level control value (multiple coefficient) $^{a}$1–$^{a}$4 from the multiple coefficient generator 21 are supplied to the multipliers A1, A2, A3 and A4 respectively. The multiple coefficients $^{a}$1–$^{a}$4 are controlled independently. The multiplier A2 shown in FIG. 4(*b*) will control feedback degree on the feedback path. In this case, the multiplier A2 has an ability to represent a resonance characteristic as frequency characteristic of the multiple filter flow.

Next, the operation of the filter system for forming the above-mentioned multiple filter flows will be described by referring to FIG. 2, FIG. 4 and FIG. 5.

11. Operation of Filter System

FIG. 4(*a*) is an example of the block diagram showing the filter system. In FIG. 4(*a*), the filter units FU1, FU2, FU3 and FU4 are connected in parallel, and the output signals of the filter units are controlled independently by multiple A1, A2, A3 and A4, respectively. And also, these output signals are added.

Figure 5A:
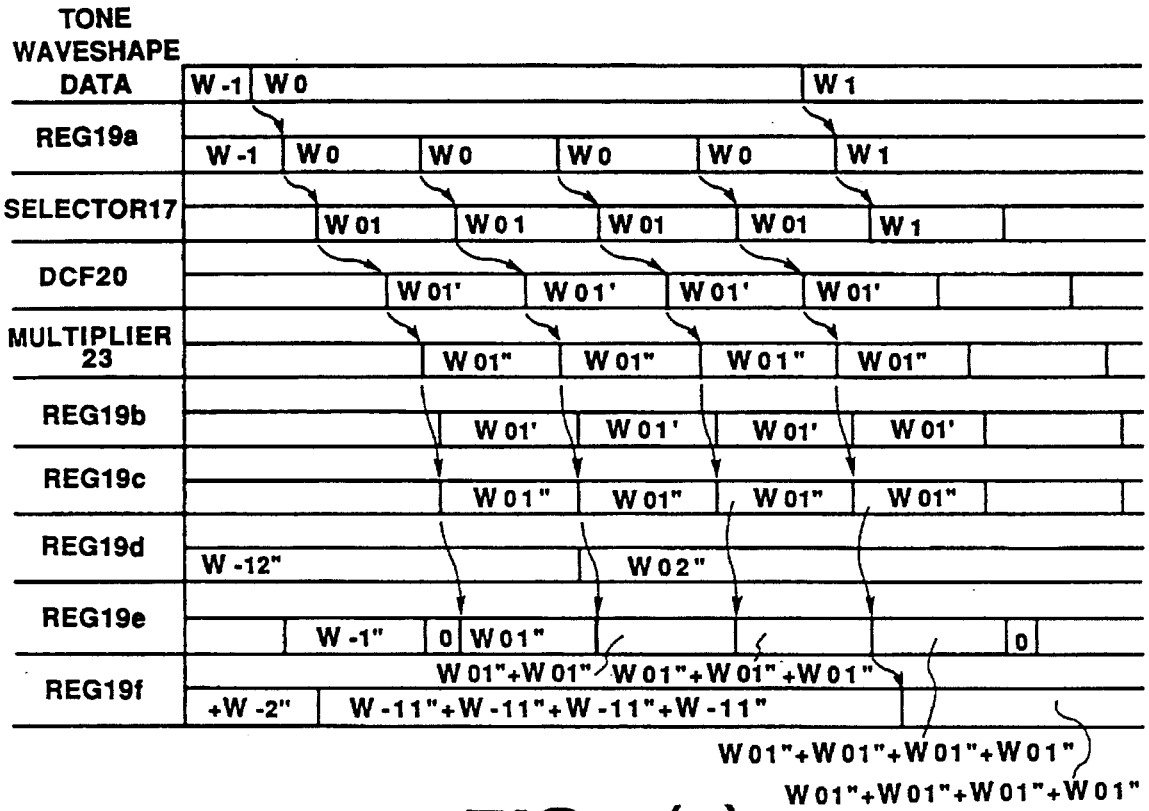
FIG. 5(*a*)–(*c*) are timing charts showing operations of the filter flows.
Figure 5B:
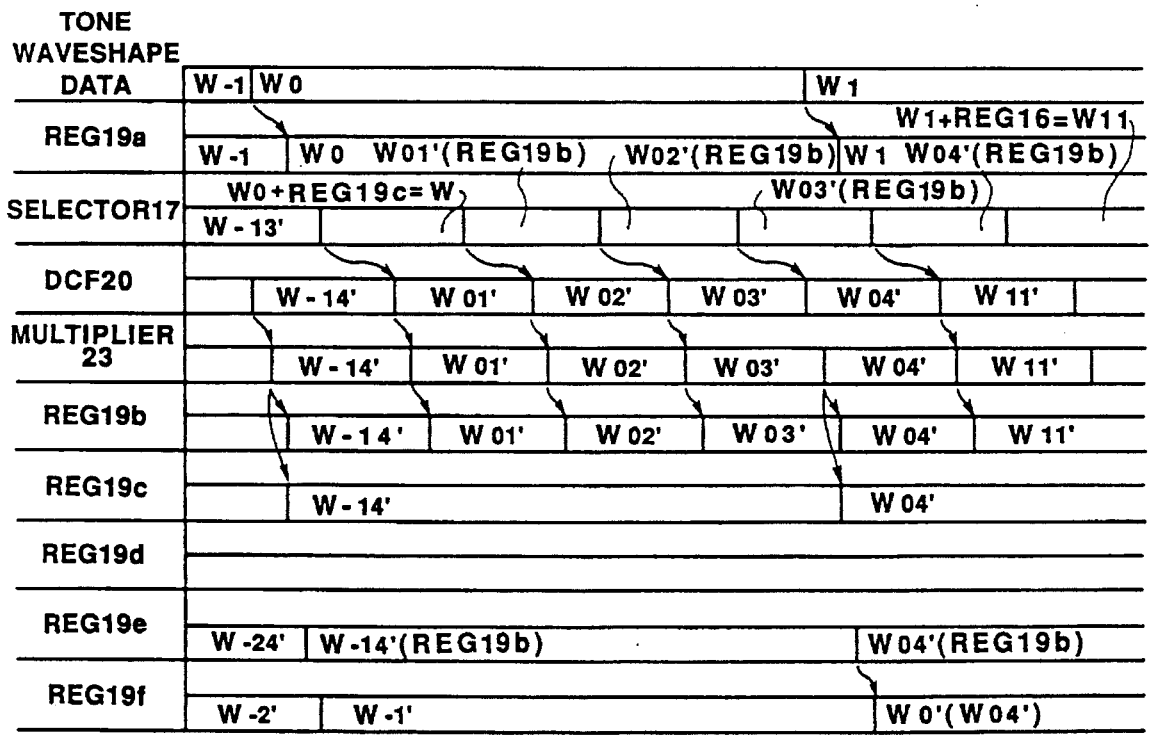
Figure 5C:
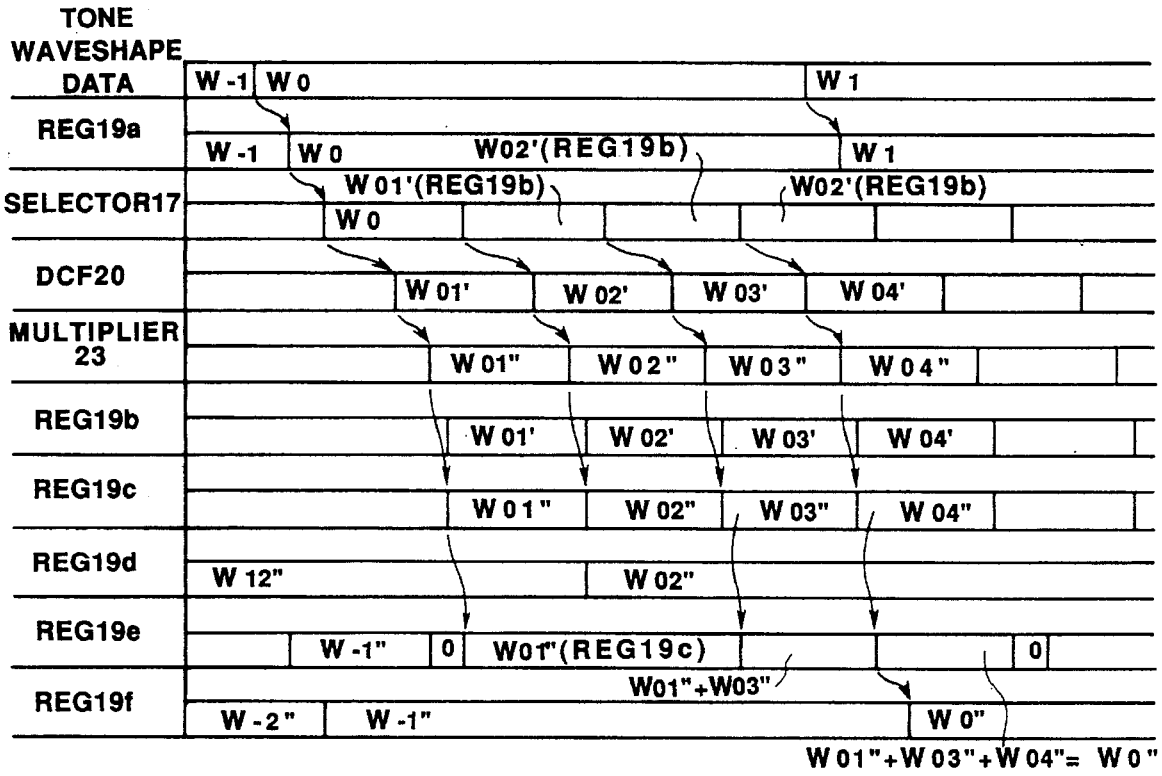

In this case, each portion of the filter system is operated with the procedure as shown in FIG. 5(*a*). First of all, the tone waveshape data $W_0$ is latched by REG 19*a*. The selector 17 outputs selectively data which is supplied to the input-terminal $Q_0$ corresponding to the select signals S0, S1, S2. Here, the tone waveshape data $W_0$ from the selector 17 defines $W_{01}$. The tone waveshape data $W_{01}$ is filtered by the DCF 20 as $W_{01}$ shown in FIG. 4(*a*), and then supplied to the multiplier 23 as the tone waveshape data $W_{01}'$. And, the multiple coefficient $a_1$ from the multiple coefficient generator 21 is supplied to the above-mentioned multiplier 23. Thus, the multiplier 23 multiplies the tone waveshape data $W_{01}'$ by the multiple coefficient $a_1$, and outputs the multiplied result as tone waveshape data $W_{01}''$ shown in FIG. 4(*a*). The tone waveshape data $W_{01}''$ is latched by the REG 19*c*. Next, the selector 18*b* outputs the output data of the REG 19*c*, which is the tone waveshape data $W_{01}''$, to the adder 24 according to the select signal S3. In the adder 24, the output data of the REG 19*e* and the tone waveshape data $W_{01}''$ are added. As REG 19*e* is cleared to zero by initial establishment, the output data of the adder 24 is the tone waveshape data $W_{01}''$. The tone waveshape data $W_{01}''$ is latched by REG 19*e*.

Next, the selector 17 outputs selectively data which is received into the input-terminal $Q_0$ again. In this case, the selector 17 outputs the data of REG 19*a*, i.e., the tone waveshape data $W_0$. Hereinafter, the above-mentioned each portion outputs the tone waveshape data $W_{01}''$ to the REG 19*c* in the same way as the above-mentioned operation for the first filter flow FU1. The tone waveshape data $W_{01}''$ from the REG 19*c* is supplied to adder 24 by selector 24. In the adder 24, the output data of the REG 19*e* and the tone waveshape data $W_{01}''$ are added. The output data of the adder 24 will be a tone waveshape data $W_{01}''+W_{01}$ because the tone waveshape data $W_{01}''$ is latched in REG 19. The tone waveshape data $W_{01}''$ is latched in REG 19*e* (refer to FIG. 4(*a*)).

Filtering as described above is repeated two times more, and then finally, the REG 19*e* latches a tone waveshape data $W_{01}''+W_{01}''+W_{01}''$. Next, the tone waveshape data $W_{01}''+W_{01}''+W_{01}''$ is latched in REG 19*f* and outputted (refer to the tone waveshape data $W_{01}''+W_{01}''+W_{01}''+W_{01}''$ in FIG. 4(*a*)). Further, multiple coefficient ai is changed as $a_1$, $a_2$, $a_3$ and $a_4$ at each stage of the time sharing. In these circumstances, the multiple filter system is formed from an individual filter flow unit with the use of the time sharing concern.

Next, another example of a filter flow will be described, which is formed with filter units FU1, FU2, FU3 and FU4 connected in series and fed back by multiplier A2, show in FIG. 4(*b*). In this case, each portion of the filter system is operated with procedure as shown in FIG. 5(*b*). First of all, the tone waveshape data $W_0$ is latched by the REG 19*a*. And the selector 17 outputs selectively a data which is supplied into the input-terminal $Q_3$ according to the select signal S0, S1 and S2 from the controller 16. Thus, the output data of the selector 17 will be data added to the tone waveshape data $W_0$ and the output of the REG 19*c*. And, the REG 19*c* latches the former data of the tone waveshape data $W_{-14}''$ (not described). Therefore, the selector 17 outputs the added data as tone waveshape data $W_0+W_{-14}''$. Hereinafter, the output data from the selector 17 is referred to as tone waveshape data $W_{01}$. The tone waveshape data $W_{01}$ is supplied to the DCF 20, and filtered (refer to $W_{01}$ in FIG. 4(*b*)). And then, the filtered tone waveshape data is supplied to the REG 19*b* as tone waveshape data $W_{01}'$. The REG 19*b* latches the tone waveshape data $W_{01}'$.

Next, the selector 17 outputs selectively the data, supplied into input-terminal $Q_1$ according to the select signals S0, S1 and S2 from the controller 16. Therefore, the selector 17 outputs the output data of the REG 19*b* to the DCF 20. Further, tone waveshape data $W_{01}'$ is latched in the REG 19*b*, so that, same waveshape data is also filtered by the DCF 20. This filtering is repeated two times, so that the DCF 20 outputs tone waveshape data $W_{02}'$, $W_{03}'$, and $W_{04}'$ one by one (refer to $W_{02}'$, $W_{03}'$ and $W_{04}'$ in FIG. 4 (*b*)). And then, tone waveshape data $W_{04}'$, which is the last data, is latched by REG 19*b*, further supplied to multiplier 23. Next, the selector 18*b* supplies selectively the tone waveshape data $W_{04}'$ as the output data of REG 19*b* to adder 24 according to the select signal S3. And, the output data of the REG 19*e* and tone waveshape data $W_{04}'$ is added in adder 24. The output data of the adder 24 will be a tone waveshape data $W_{04}'$ unchanged because the REG 19*e* has been cleared to zero by initial establishment. The tone waveshape data $W_{04}'$ is latched by REG 193. This tone waveshape data $W_{04}$ is latched in REG 19*f* and outputted. On the other hand, multiple coefficient $a_2$ is supplied to multiplier 23, so that multiple coefficient $a_2$ and tone waveshape data $W_{04}'$ are multiplied in multiplier 23. Then, the result of multiplying is latched by REG 9*c* as tone waveshape data $W_{04}''$, which is used as input data of the filter system 15 at next stage. In these circumstances, the filter flow function is formed by the multiple filter system by time sharing.

Furthermore, description will be given another example of the filter flow, which is formed with filter units FU1, FU2, FU3 and FU4 connected in series and fed back by multiplier A2, as shown in FIG. 4(*d*). In this case, each portion of the filter system is operated with procedure as shown in FIG. 5(*c*). First of all, tone waveshape data $W_0$ is latched by REG 19*a*. And, the selector 17 outputs selectively data which is supplied to input-terminal $Q_0$. Therefore, the selector 17 outputs tone waveshape data $W_0$. This tone waveshape data $W_0$ is filtered by DCF 20, and then outputted from DCF 20 as waveshape data $W_{01}'$. This tone waveshape data $W_{01}'$ is latched by REG 19*b* (refer to $W_{01}'$ in FIG. 4(*d*)). And, the multiple coefficient $a_1$ from the multiple coefficient generator 21 is supplied to the multiplier 23. In the multiplier 23, the level of tone waveshape data $W_{01}$ is controlled according to the multiple coefficient $a_1$. Here, this controlled tone waveshape data is defined as the tone waveshape data $W_{01}''$ (refer to $W_{01}''$ in FIG. 4(*d*)). The tone waveshape data $W_{01}''$ is latched by the REG 19*c*, and is supplied to the adder 24 through the selector 18*b*. So, in the adder 24 the tone waveshape data $W_{01}'$ and the output data of the REG 19*e* is added. The output data of the adder 24 will be a tone waveshape data $W_{04}''$ unchanged because the mentioned above REG 19*e* has been cleared to zero by initial establishment. Therefore, the tone waveshape data $W_{01}''$ is latched by the REG 19*e* without any operation.

Next, the above-mentioned selector 17 outputs selectively data which is supplied into the input-terminal $Q_1$. Thus, the selector 17 outputs data of the REG 19*b* to the DCF 20. In the REG 19*b*, the tone waveshape data $W_{01}'$ is latched, the tone waveshape data $W_{01}'$ is filtered again, and becomes tone waveshape data $W_{02}'$ (refer to $W_{02}'$ in FIG. 4(*d*)). The tone waveshape data $W_{02}'$ is supplied to the REG 19*b* and the multiplier 23 in the same way as the above-mentioned operation. The REG 19*b* latches the tone waveshape data $W_{02}'$, and outputs to the input-terminal of the selector 17.

On the other hand, the level of the tone waveshape data $W_{02}'$ which is supplied to the multiplier 23 is controlled according to multiple coefficient $a_1$. Herein, the multiple coefficient $a_1$ is settled on 1. The level-controlled tone waveshape data $W_{02}''$ (=$W_{02}'$) is latched by the REG 19*c* and the REG 19*d*. However, at this time, the output data of the REG 19*c* is not supplied to the adder 24 though the selector 18*b*. Thus, the REG 19*e* holds the above-mentioned tone waveshape data $W_{01}''$.

Next, the selector 17 outputs the output data of the REG 19*b*, which is supplied to the input-terminal $Q_1$, to the DCF 20 according to select signals S0, S1 and S2 from the controller 16. As REG 19*b* latches the tone waveshape data $W_{02}'$, the tone waveshape data $W_{02}'$ is filtered by DCF 20 and then is outputted from DCF 20 as a tone waveshape data $W_{03}'$ (refer to FIG. 4(*d*)). Then, the tone waveshape data $W_{03}'$ is supplied to the REG 19*b* and the multiplier 23. In multiplier 23, the multiple coefficient $a_3$ from the multiple coefficient generator 21 is also supplied. Thus, the multiplier 23 controls the level of the tone waveshape data $W_{03}'$ according to the multiple coefficient $a_3$. Hereinafter, the controlled tone waveshape data is referred to as tone waveshape data $W_{03}''$ shown in FIG. 4(*d*). And then, the tone waveshape data $W_{03}''$ is latched by the REG 19*c*. Furthermore, the tone waveshape data $W_{03}''$ from the REG 19*c* is supplied to the adder 24 through the selector 18*b*. In the adder 18*b*, the tone waveshape data $W_{03}''$ and the output data of the REG 19*e* are added. Therefore, the adder 24 outputs the tone waveshape data $W_{01}''+W_{03}''$, because the tone waveshape data $W_{01}''$ has been latched by REG 19*e*. And then, the tone waveshape data $W_{01}''+W_{03}''$ is latched by REG 19*e*.

Next, the selector 17 selects the input-terminal $Q_4$ side, which is inputted the output data of the REG 19*d*, and outputs the selected data to the DCF 20. Thus, the tone waveshape data $W_{02}''$ (=$W_{02}'$) being latched by the REG 19*d* is filtered by the DCF 20 again. Hereinafter, the filtered tone waveshape data is referred to as tone waveshape data $W_{04}'$ shown in FIG. 4(*d*). The tone waveshape data $W_{04}'$ is supplied to the REG 19*b* and to the multiplier 23. The REG 19*b* latches the tone waveshape data $W_{04}'$. However, the multiplier 23 controls a level of the tone waveshape data $W_{04}'$ according to the multiple coefficient $a_4'$. The output signal of multiplier 23, as tone waveshape data $W_{04}''$ is latched by REG 19*c* (refer to $W_{04}''$ in FIG. 4(*d*)). The tone waveshape data $W_{04}''$ is supplied to the adder 24 through the selector 18*b*. In the adder 24, the tone waveshape data $W_{04}''$ and the output data of the REG 19*e* are added. Therefore, in this case, the adder 24 outputs tone waveshape data $W_{01}''+W_{03}''+W_{04}''$, because the REG 19*e* latches the tone waveshape data $W_{01}''+W_{03}''$ as mentioned above (refer to $W_{01}''+W_{03}''+W_{04}''$ in FIG. 4(*d*)). Then, tone waveshape data $W_{01}''+W_{03}''+W_{04}''$ is latched by the REG 19*e* and the REG 19*f*, and is outputted.

As explained above, the multiple filter flows shown in FIG. 4(*a*)–(*h*) are formed by the filter system 15.

Next, the controller 16 shown in FIG. 2 will be described by referring to block diagrams shown in FIG. 6 and FIG. 7.

2. Configuration of Controller 16

Figure 6:
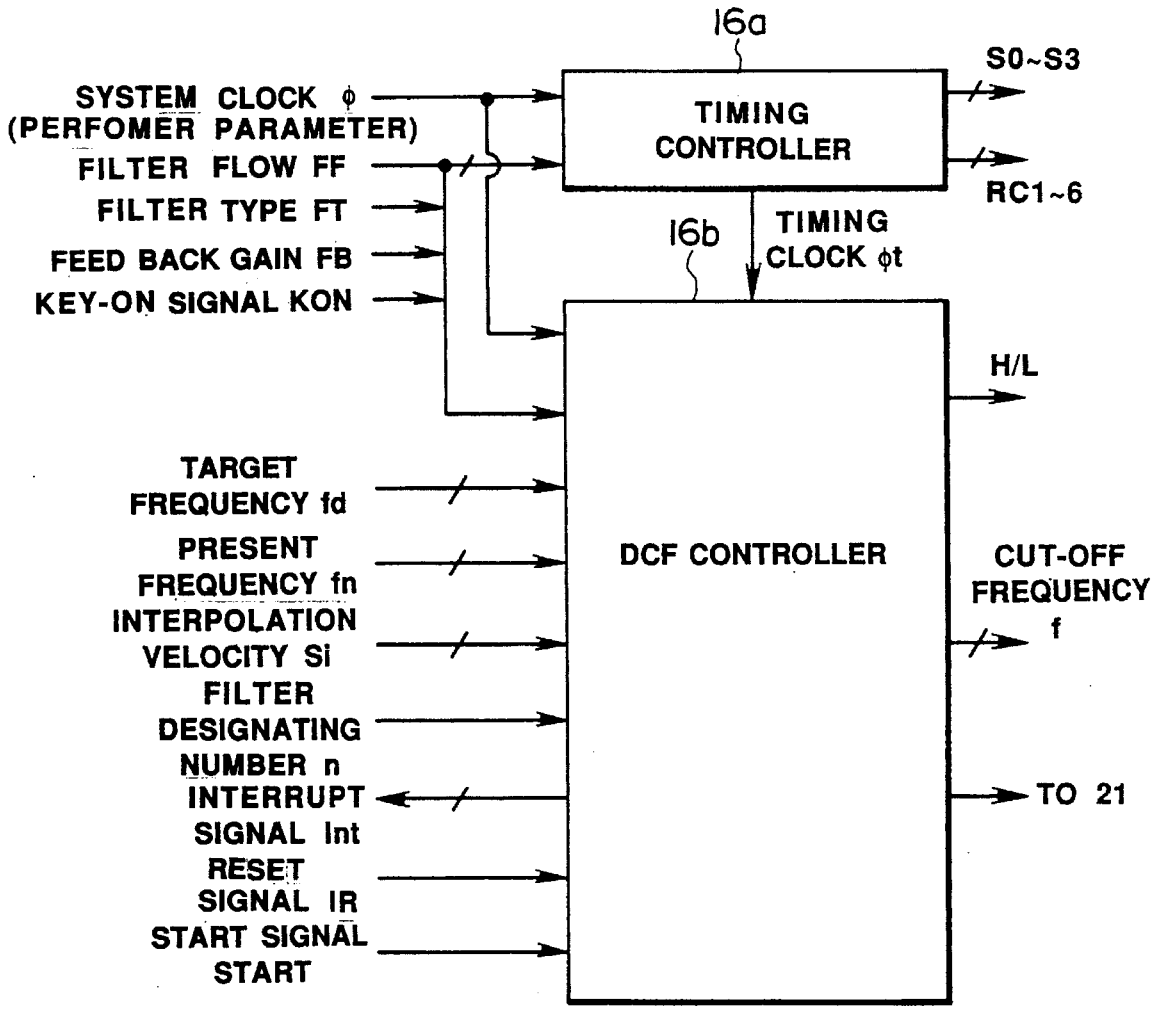
FIG. 6 is a block diagram showing a controller 16 show in FIG. 2.

In FIG. 6, the controller 16 consists of a timing controller 16*a* and a DCF controller 16*b*. The timing controller 16*a* outputs the above-mentioned signals SO, S1, S2 and the control signals RC1–RC6 on the basis of a system clock ø, a time-sharing control signal (from the system controller 13) and operating parameters, such as a filter flow FF, a filter type TP, a feed back gain FB, a key-on signal KON and so on shown in FIG. 2. Next, the DCF controller 16*b* transmits the cut-off frequency f and the H/L signal to the DCF 20. Here, H/L signal designates either the LPF or the HPF output to be transmitted to the DCF 20. The DCF controller 16*b* also outputs a control signal to the multiple coefficient generator 21. The DCF controller 16 receives the present frequency fn, the target frequency fd and the interpolation velocity Si, as the above-mentioned tone designation information. The DCF controller 16 calculates interpolation data between discrete data using liner interpolation in each fixed interval. In this case, the discrete data are the present frequency fn and the target frequency fd (fd is not equal to fn). Thus, the interpolation data is a cut-off frequency f which changes from the present frequency fn to the target frequency fd in each fixed interval. The DCF controller 16*b* outputs the interrupt signal Int to the controller system 13 when the cut-off frequency f reaches the frequency fd. The interrupt signal Int is outputted according to each of filter units FU1, FU2, FU3 and FU4.

Furthermore, the above-mentioned calculation method will be described by referring to block diagram of the DCF controller 16*b* shown in FIG. 7.

3. Configuration of DCF Controller 16*b*

Figure 7:
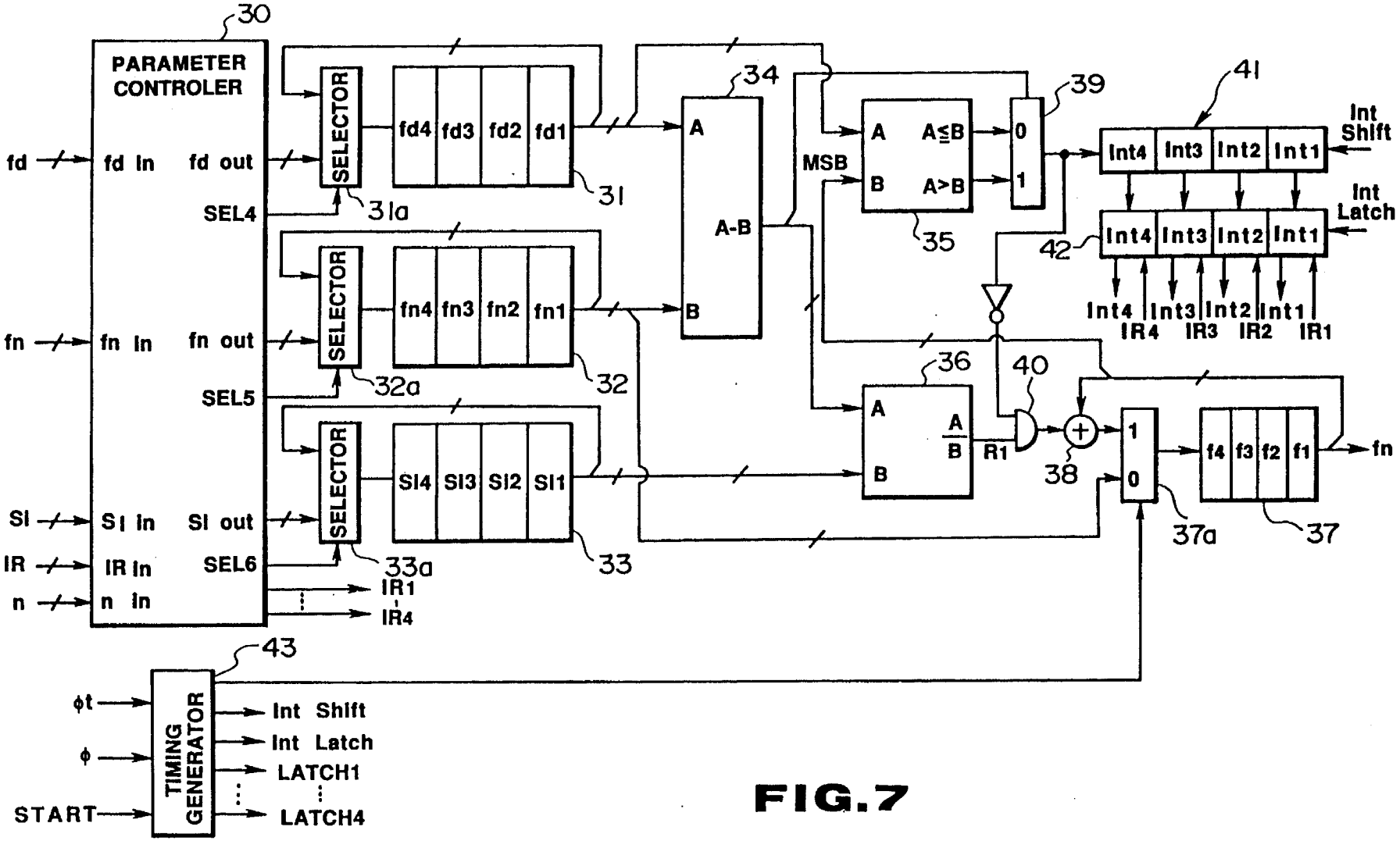
FIG. 7 is a block diagram showing a DCF controller 16*b* show in FIG. 6.

In FIG. 7, the parameter controller 30 outputs the target frequency fd, the present frequency fn and interpolation velocity Si to selectors 31*a*, 32*a* and 33*a*, according to the state of filter designating number n. The selector 31*a* has two input-terminals, one of which terminals supplies data to a register 31, according to the signal S4 in fixed timing. One of the supplied data is the above-mentioned target frequency fd, and another is output data of the register 31. The register 31 has four cells, and each cell can store the target frequency fd in each stage of time sharing. The data in each cell are moved to a neighboring cell counterclockwise through the selector 31*a* in fixed timing. The data in the output-end cell in the register 31 is supplied to the selector 31*a*. Then, the selector 31*a* outputs either of two data which are supplied, and this output data are stored into the input-end cell of the register 31. The register 32 and the selector 32*a*, the register 33 and the selector 32*a* are constructed in the same way as mentioned above. Therefore, the register 31 and the selector 31*a* circulates the target frequency fd; the register 32 and the selector 32*a* circulates the present frequency fn; and the register 33 and the selector 33*a* circulates the interpolation velocity Si. These data are used to calculate the cut-off frequency f of the filter units FU1–FU4 shown in FIG. 4(*a*)–(*h*).

Furthermore, the data of the output-end cell in the register 31 are also supplied an input-terminal A of a subtractor 34 and an input-terminal A of a comparator 35. The data of the output-end cell in the register 32 are supplied to a terminal B of the subtractor 34 and a selector 37*a*. The data of the output-end cell in the register 33 is supplied to a terminal B of a divider 36.

Next, the subtractor 34 calculates a level difference $D_1$ by subtracting from the target frequency fd to the present frequency fn. The level difference $D_1$ is digital data consisting of a plurality of bits, which difference without the MSB bit are supplied to an input-terminal A of the divider 36. While, the MSB bit of the level difference $D_1$ is supplied to the select terminal of the selector 39. The divider 36 calculates a rate of increase $R_1$ (hereinafter, referred t as rate) by dividing the level difference $D_1$ by interpolation velocity Si, and outputs the result to the AND circuit 40. The AND circuit 40 outputs logic product between the negative data of the output of selector 39 and the rate $R_1$ to the adder 38. The adder 38 adds the output data of the register 37 and the logic product. The added data is supplied to the selector 37*a*. The circuit which consists of the register 37 and the selector 37*a* circulates data in cells of the register 37 in the same way as mentioned above, as the selector 31*a* and the register 31. The circulated data are supplied as the present frequency fn to the DCF 20, an input-terminal B of the comparator 35 and the adder 38. The comparator 35 compares the target frequency fd with the present frequency fn of the register 37. And, in accordance with the result of comparing, that is, when the present fn does not reach to the target frequency fd yet, a digit(1) is supplied to the selector 39, while, when the present frequency fn reaches the target frequency fd, a digit(0) is supplied to the selector 39.

The selector 39 transmits the output data (1 or 0) of the comparator 35 to a shift register 41, according to the state of the MSB bit (which is the mentioned above sign bit of the level difference $D_1$). The shift register 41 consists of four cells, and moves written data in each cell to the right side, and in the same time, stores the output data of the selector 39 into the input-end cell, with timing clock Int-Shift. Each data in the cells is supplied to the cell of the latch circuit 42, when the data corresponding with the filter designating number (1), i.e. data $Int_1$, is moved into the output-end cell of the shift register 41. The latch circuit 42 latches and outputs the data from shift register 41 with timing clock int-Latch, and outputs each data to the system controller 13.

The timing generator 43 outputs various timing clocks, IntShift, Int-Latch, fSEL, LATCH1–LATCH4 and START to input-terminals of the registers and shift registers. The timing clock Int-Shift and Int-Latch are supplied to the shift register 41 and the latch circuit 42, respectively. The timing clocks LATCH1–LATCH4 are supplied to the register 31, 32, 33 and 37, respectively. The circulation of data in the register 31, 32, 33, 37 and the shift register 41 synchronize with the above-mentioned clocks. For example, the DCF controller 16 shown in FIG. 7 is in fixed stage, as the cut-off frequency $f_1$ for the first stage of the DCF 20(FU1) is calculated (see registers 31, 32 and 33), and outputs the cut-off frequency $f_1$ for the filter unit FU2.

Next, the multiple coefficient generator 21 will be described by referring to block diagram in FIG. 8.

4. Configuration of the Multiple Coefficient Generator 21

Figure 8:
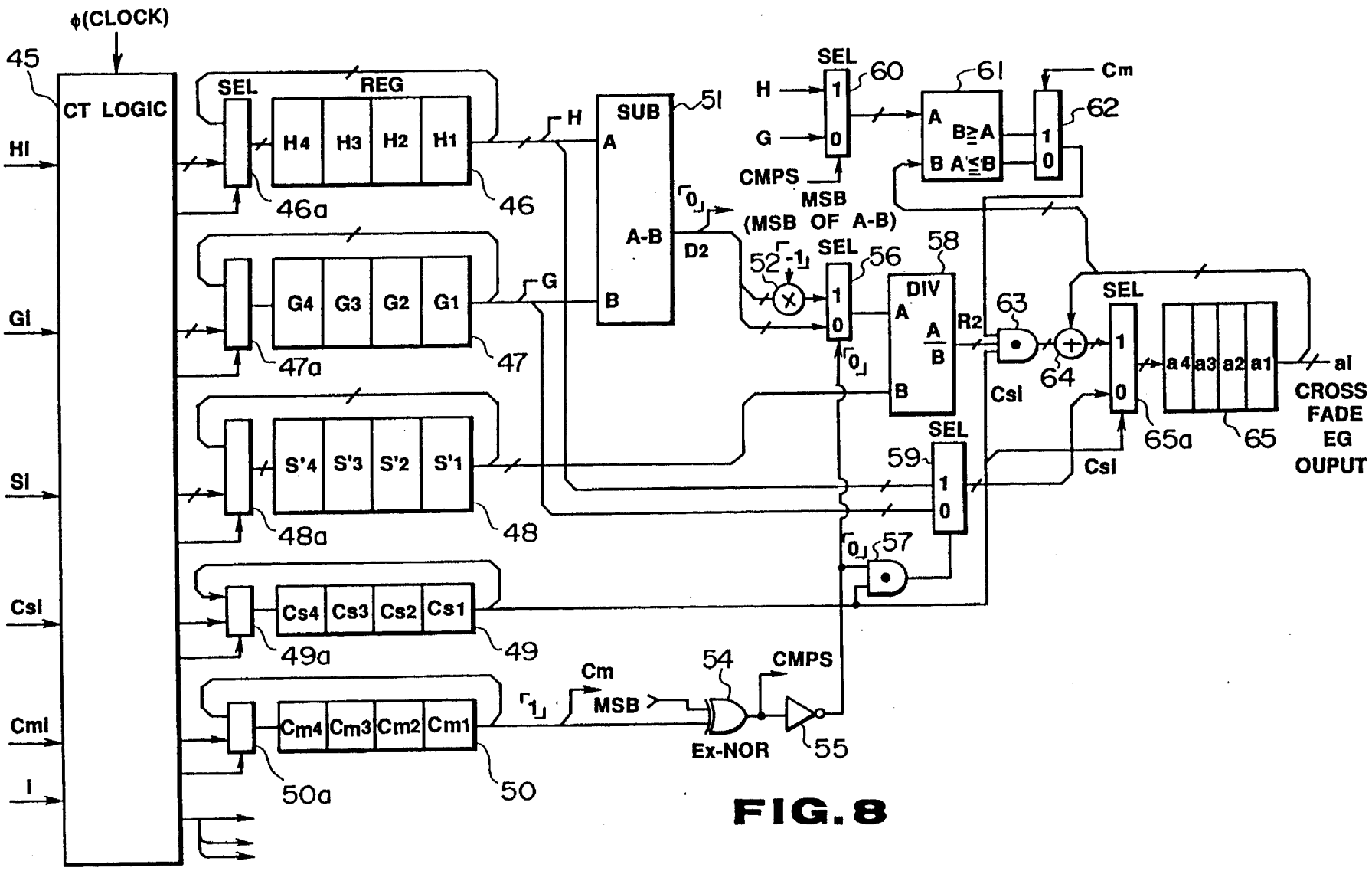
FIG. 8 is a block diagram showing a multiple coefficient generator 21 shown in FIG. 2.

In FIG. 8, the multiple coefficient generator 21 calculates the coefficient ai (i=1, 2, 3 and 4) for each filter unit FU1, FU2, FU3 and FU4, on the basis of the interpolation velocity Si' in each stage of time sharing, when the present data Hi and the target data Gi are inputted. That is, the coefficient ai will be a value between the present data Gi and the target data Hi. In this figure, various data, such as the filter designating number n, the present data Gi, the target data Hi, the interpolation velocity Si', the start signal Csi and the direction data Cmi are supplied to the control timing (CT) logic 45. The start signal Csi is the same signal as the above-mentioned start signal START, and orders the multiple coefficient generator 21 to calculate the coefficients $a_1$–$A_4$. The direction data Cmi indicate a relation between the present data Gi and the target data Hi. That is, the direction data Cmi will be (0) when the target Hi is smaller than the present data Gi, and will be (1) when opposite condition exists. The CT logic 45 outputs the present data Gi, the target data Hi, the interpolation velocity Si', the start signal Csi and the direction data Cmi to the selectors 46*a*, 47*a*, 48*a*, 49*a* and 50*a*, respectively.

Each register 46, 47, 48, 49 and 50 consists of four cells in the same means as the above-mentioned registers 31–33, and also circulate data in the cells through each selector 46*a*, 47*a*, 48*a*, 49*a* and 50*a*. In the register 46, either of the output data of register 46 or the target data Hi from the CT logic 45 is stored in the input-end cell though the selector 46*a*. The register 46 outputs the target data Hi of the output-end cell to the input-terminal A of the subtractor 51 and the selector 59. In the register 47, either of the output data of register 47 or the present data Gi from the CT logic 45 is stored into the input-end cell though the selector 47*a*. The register 47 outputs the present data Gi to the input-terminal B of the subtractor 51 and the selector 59. Furthermore, in the register 48, either of the output data of register 48 or the interpolation velocity Si' from the Ct logic 45 is stored into the input-end cell though the selector 48*a*. The interpolation velocity Si' from the register 48 is supplied to the input-terminal B of the divider 58. In register 49, either of the output data therefrom or the start data Csi from the CT logic 45 is stored into the input-end cell, and the start data Csi from the output-end cell is supplied to the input-terminal of AND circuit 57, the input-terminal of AND circuit 63 and the selector 65*a*. Either of the output data from the register 50 or the direction data Cmi from the CT logic 45 is stored in the input-end cell of the register 50. Then, the direction data Cmi from the register 50 is supplied to the input-terminal of the Ex-OR circuit 54 and the select-terminal of the selector 62.

Next, the subtractor 51 calculates a level difference $D_2$ by subtracting the present data Gi from the target data Hi. The level difference $D_2$ without the MSB bit is supplied to the multiplier 52 and the selector 56. The MSB bit is a sign bit, and will be (0) when the target data Hi is equal to or larger than the present data Gi, and will be (1) when the target data Hi is less than the present data Gi. The MSB bit is supplied to another input-terminal of the Ex-OR circuit 54.

The multiplier 52 multiplies the level difference $D_2$ and a coefficient (−1), and outputs the result to the selector 56. The Exclusive Or (Ex-Or) circuit 54 gives an exclusive logic sum between the MSB bit of the level difference $D_2$ and the direction data Cmi. Thus, the Ex-Or circuit 54 gives a truth table as follows:

| Cmi | MSB | the result |
|---|---|---|
| 0 | 0 | 0 |
| 0 | 1 | 1 |
| 1 | 0 | 1 |
| 1 | 1 | 1 |

The above-mentioned result according to the state of the direction data Cmi and the MSB bit is supplied to the selector 60 as select signal CMPS. The selector 60 selects either of the target data Hi or the present data Gi, and also supplies the selected data to the selector 56 though the NOT circuit 55, and supplies another input-terminal of the AND circuit 57. The selector 56 selects either of the level difference $D_2$ or the product of multiplying the level difference $D_2$ by minus one (i.e. $-D_2$), on the basis of the data from the NOT circuit 55, and outputs the selected data to the input-terminal A of the divider 58. The divider 58 calculates a rate of increase $R_2$ (hereinafter, referred to as rate $R_2$) by dividing the output data of the selector 56 by interpolation velocity Si', and outputs the calculated result to the AND circuit 63.

Next, the selector 60 selects either of the target data Hi or the present data Gi, on the basis of the state of the select signal CMPS, and outputs the selected data to the input-terminal A of the comparator 61. The comparator 61 compares data supplied to the input-terminal A (the target data Hi or the present data Gi), with the data supplied into the input-terminal B (the output data of the register 65, which is described later), and sets a digit on either of the two output-terminals. That is, if the data of the input-terminal A is equal or larger than the data of the input-terminal B, digit (1) is set on one side of the output terminals, while, if the data of the input-terminal A is less than the data of the input-terminal B, digit (1) is set on the other of the output terminals. The both digits are supplied to the selector 62, respectively. The selector 62 selects one of the above-mentioned digits, according to the direction data Cmi which is supplied as select-signal, and outputs the selected data to the AND circuit 63. The AND circuit 63 outputs the rate $R_2$ to the adder 64 only when the start signal START and the output data from the selector 62 are digits (1). The adder 64 adds the rate $R_2$ and the output data of the register 64, and outputs the added data to the selector 65*a*.

The selector 65*a* outputs either of the added data or the output data from the selector 59 to the register 64, when the start signal Csi is supplied. The register 65 consists of four cells in the same way as the above-mentioned register 46–50, and stores the output data from the selector 65*a* to the input-end cell, and outputs the data in the output-end cell to the adder 64 and the adder 23 (shown FIG. 2), as the coefficient ai.

Figure 10:
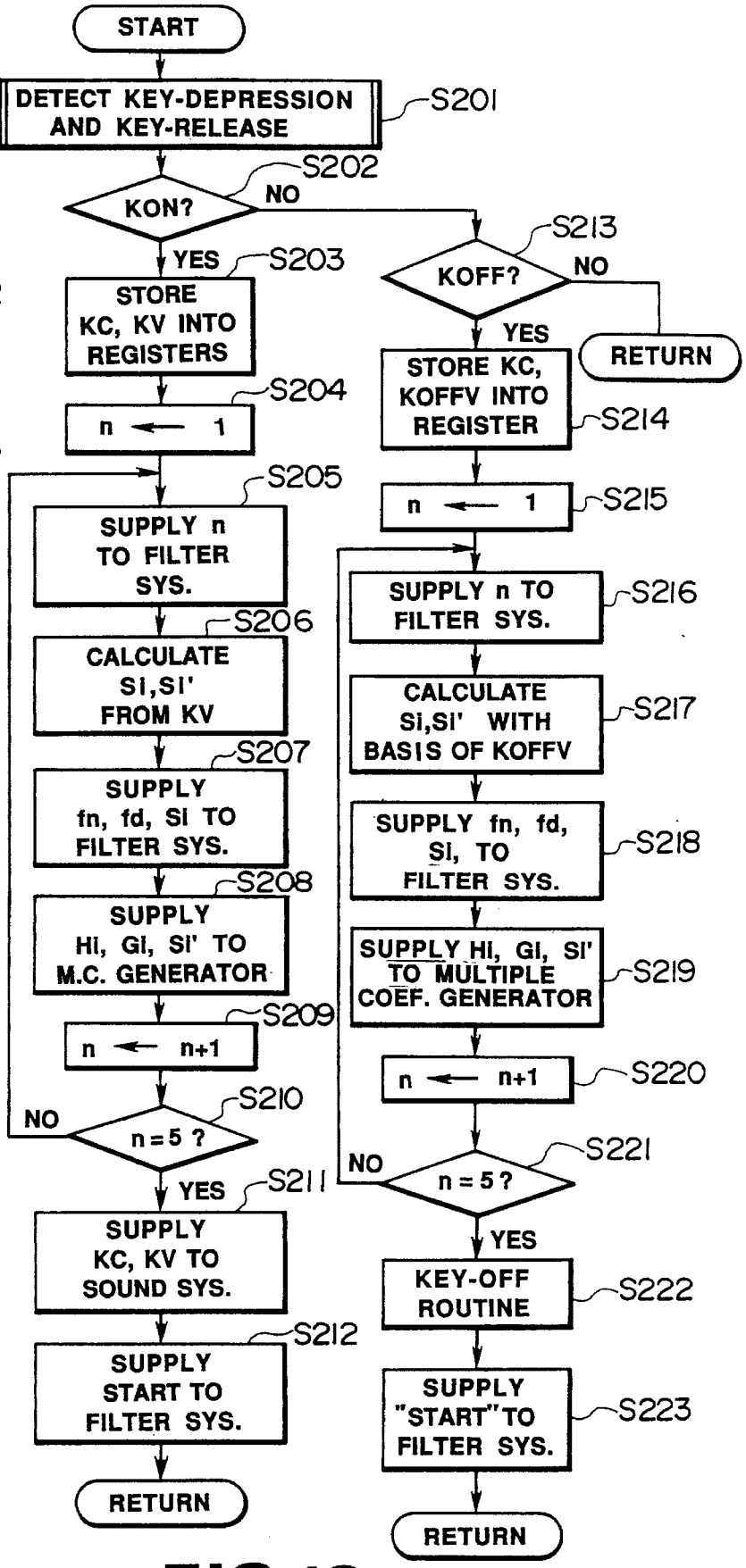
FIG. 10 is a flow chart showing a key routine shown in FIG. 9.
Figure 11A:
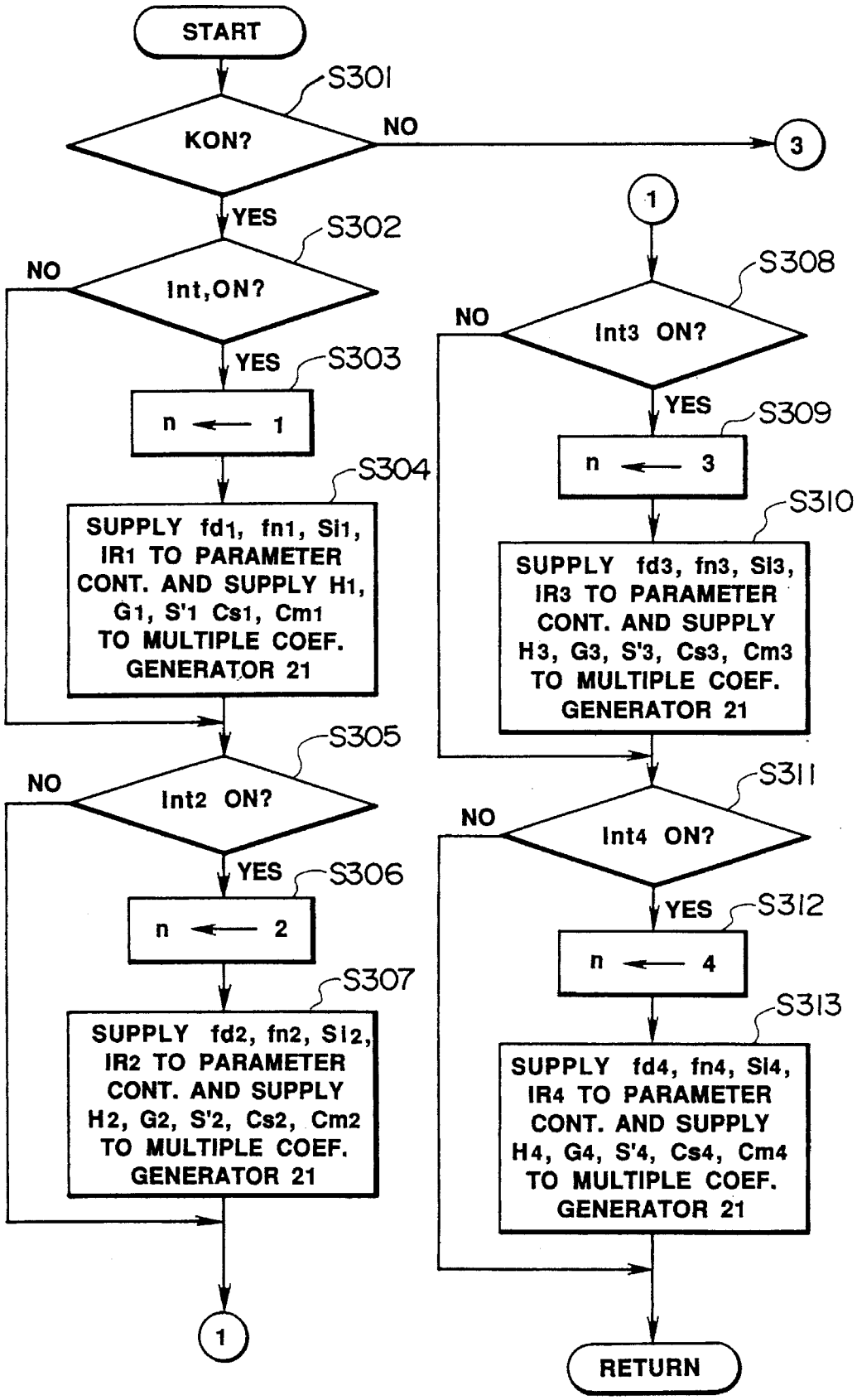
FIG. 11(*a*) and (*b*) are flow charts showing a key-on/off detecting routine shown in FIG. 10
Figure 11B:
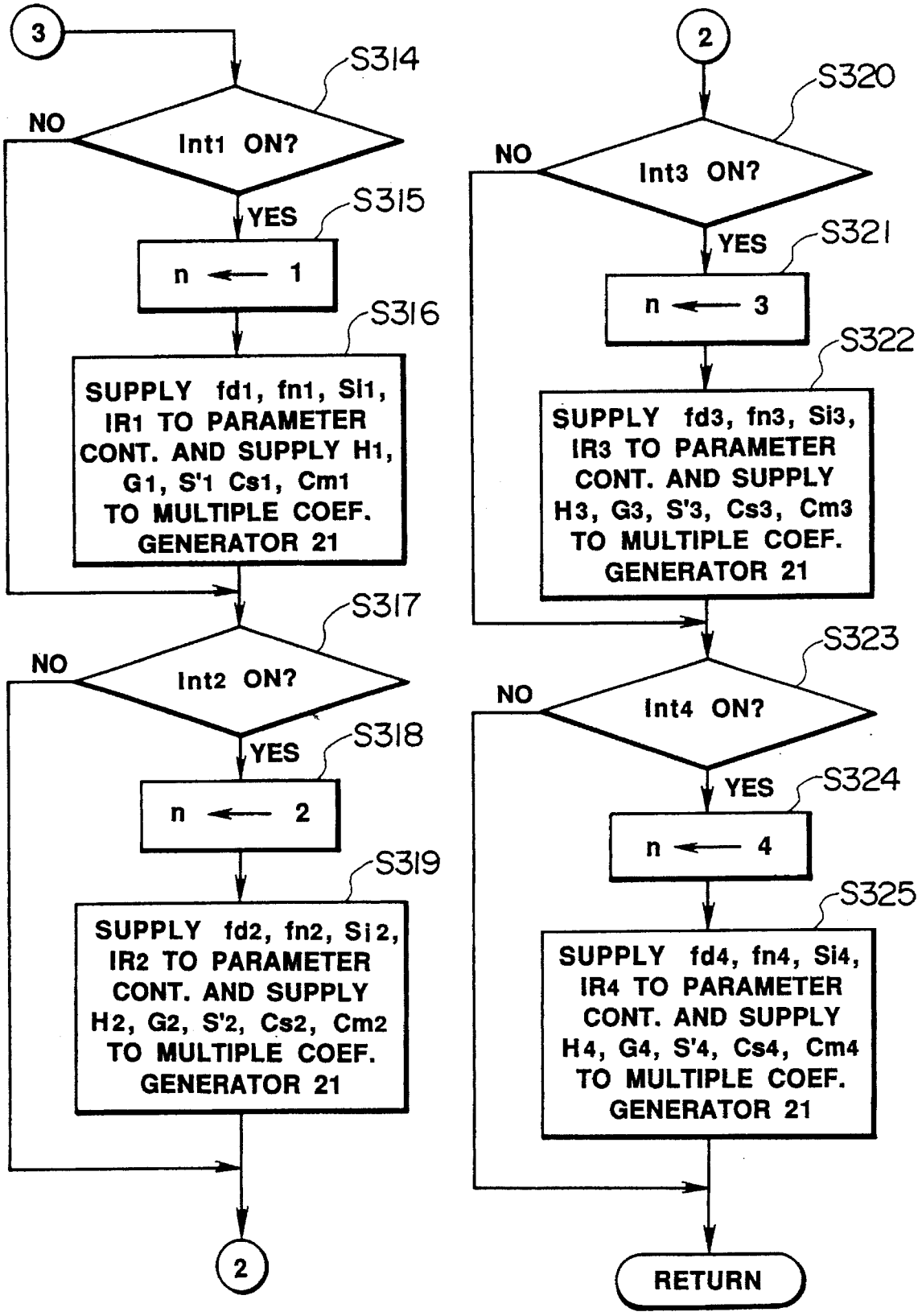

Next, the operation of the above described electrical musical instrument will be described by referring to flow charts in FIG. 9, FIG. 10 and FIG. 11.

B. Operation of Embodiment

Figure 9:
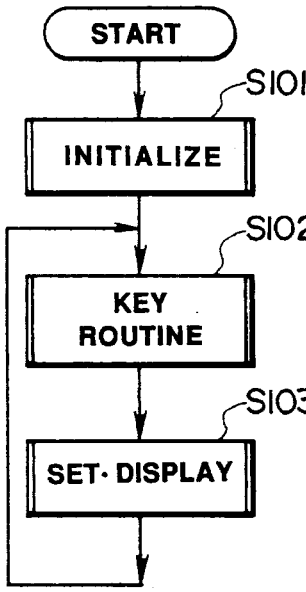
FIG. 9 is a flow chart showing a main routine of the embodiment.

FIG. 9 is the flow chart showing the operation of the system controller in performance. This is main routine which is started by system controller 13 when the power is applied.

At step S101, system controller 13 initializes parameters and registers. At step S102, the key routine shown in FIG. 10 is performed. In FIG. 10, key-depression and key-release are detected at step S201. If any key is pressed by performer, the key-on signal KON and the key-on velocity KV from keyboard 11 are supplied to the system controller 13. Then, the system controller 13 proceeds to step S202 in which a test is performed whether the key-on signal KON is inputted or not. If the result is positive, controls proceeds to step S203. At step S203, the key-on signal KON and the key-on velocity KV are stored into registers. Next, at step S204, the system controller 13 sets digit (1) in the filter designating number n. Then, the system controller 13 proceeds to step S205, the filter designating number n is supplied to the parameter controller 30 and the Ct logic 45. Then, at step S206, the interpolation velocities Si and Si' are calculated on the basis of the key-on velocity KV. However, the interpolation velocities Si and Si' may also be obtained by loading from a table (memory) in which the interpolation velocities Si and Si' are previously stored therein, according to the key-on velocity KV. However, the interpolation velocities Si and Si' will be $S_1$, $S_1'$ for the filter designating number n (=1), respectively.

Then, at step S207, the target frequency $fd_1$, the present frequency $fn_1$ of the DCF 20 and the interpolation velocity $S_1$ are supplied to the parameter controller 30. The parameter controller 30 stores the forging frequencies $fd_1$, $fn_1$ and the interpolation velocity $S_1$ to each cell of the registers 31, 32 and 33, according to the filter designating number n.

Next, at step S208, the data, such as the target data $H_1$, the present data $G_1$, the interpolation velocity S1', the start signal CS1 and the direction data Cm1 are supplied to the multiple coefficient generator 21, and stored in each cell of the registers 46, 47, 48, 49 and 50, respectively.

The system controller 13 then proceeds to step S209 in which the filter designating number n is incremented. Thus, the filter designating number n will be (2). Next, at step S210, a test is performed whether the filter designating number n reaches (5) or not. That is, the test means to distinguish whether the tone designating information is established both of the DCF 20 (filter units F1–FU4) and the multiplier 23 (multiplier A1–A4) or not. In step S210, if the result is negative, the controls returns to steps S205, S206, S207, S208 and S209 are repeatedly performed until the result is positive at step S210. Therefore, the tone designating information is stored into the cells of the registers 31, 32, 33, 46, 47, 48, 49 and 50. Hereinafter, for the filter units FU2, FU3, FU4, the target frequency fd are referred to as $fd_2$, $fd_3$ and $fd_4$, and the present frequency fn are referred to as $fn_2$, $fn_3$ and $fn_4$, the interpolation velocity Si are referred to as $S_2$, $S_3$ and $S_4$. And, for the multipliers A2, A3, A4, the target data Hi are referred to as $H_2$–$H_4$, the present data Gi are referred to as $G_2$–$G_4$, the interpolation Si' are referred to as $S_2$–$S_4$, and the start signal Csi are referred to as Cs2–Cs4 (see FIG. 7 and FIG. 8).

At step S210, when the result is positive, the system controller 13 proceeds to step S211 in which keycode KC, key-on signal KON and key-on velocity KV are supplied to the tone waveshape generator 14. At step S212, the start signal START is supplied to the filter system 15, and then control returns to the main routine shown FIG. 9.

The tone waveshape generator 14 generators a tone waveshape data according to the keycode KC, key-on signal KON and key-on velocity IV from system controller 13, and outputs the tone waveshape data to the filter system 15. When the DCF controller 16*b* receives the start signal START, it circulates data in the cells of the registers 31, 32 and 33, and calculates the cut-off frequency f, between the present data fn and the target data fd, by using the tone information and the interpolation velocity Si in the output-end cells of each registers 31, 32 and 33. The multiple coefficient generator 21 synchronizes with the performance of the DCF controller 16*b*, and calculates multiple coefficients ai, between the present data Gi and the target data Hi, on the basis of the timing clocks which are from the CT logic 45.

Hereinafter, the operation of the foregoing DCF controller 16*b* and the foregoing multiple coefficient generator 21 will be described in detail.

In the DCF controller 16, the target data $fd_1$–$fd_4$, the present data $fd_1$–$fd_4$ and the interpolation velocity $S_1$–$S_4$ circulate in the registers 31, 32 and 33, and the data from each of the output-end cells is outputted. In this case, if the data states are as shown in FIG. 8, the target data $fd_1$ and the present data $fn_1$ are supplied to the input-terminal A and the input-terminal B of the subtractor 34. The subtractor 34 subtracts the present data $fn_1$ from the target data $fd_1$ (in this case, $fd_1>fn_1$), and outputs the result to the input-terminal A of the divider 36, as the level difference $D_1$.

Next, the divider 36 divides the level difference $D_1$ by the interpolation velocity $S_1$ from the register 33, and outputs the result to the AND circuit 40, as the rate $R_1$.

However, the comparator 35 compares the target data $fd_1$ with the output data of the register 37 (the present data $fn_1$ which is a final data in foregoing performance), and supplies the result to the selector 39. The selector 39 outputs the result from the comparator 35 to the AND circuit 40 and the shift register 41 on the basis of the MSB bit of the output data from the subtractor 34. In this case, the target data $fd_1$ is larger than the present data $fn_1$ as described above, therefore, the AND circuit 40 opens, then the rate $R_1$ of the divider 36 is supplied to the adder 38. The output data from the selector 39 is stored into the shift register 41.

Further, the adder 38 adds the rate $R_1$ of the divider 36 and the output data (the present data $fn_1$) of the register 37, and outputs the result to the selector 37*a*. The selector 37*a* outputs the added result of the adder 38 on the basis of the start signal START. The added result is supplied to the input-end cell of the register 37.

As described above, the registers 31, 32 and 33 circulate data in the cells counterclockwise. The register 31 outputs the target data $fd_2$, $fd_3$ and $fd_4$ to the subtractor 34 and the comparator 35, sequentially. And the register 32 outputs the present data $fn_2$, $fn_3$ and $fn_4$ to the subtractor 34 and the selector 37*a*, sequentially. Further, the register 33 outputs the interpolation velocity $S_2$, $S_3$ and $S_4$ to the divider 36, sequentially.

The, the various calculations are performed when the data from the registers are outputted in each stage, and the output data from the selector 37*a*, i.e. the cut-off frequency $f_1$–$f_4$ are stored in input-end cell of the register 37. In the register 37, each data in the cells is moved toward the output-end cell corresponding with the timing clock ø, and the outputted data from the output-end cell is supplied to the DCF 20 corresponding with the time charts shown FIG. 5, as cut-off frequency $f_1$–$f_4$. Thus, the cut-off frequency $f_1$, $f_2$, $f_3$ and $f_4$ are supplied to the filter flow FU1, FU2, FU3 and FU4 shown FIG. 4, respectively.

In the multiple coefficient generator 21, the data stored into each register 46, 47, 48, 49 and 50 are circulated corresponding with operations of the DCF controller 16*b*. The above-mentioned data contains the target data $H_1$–$H_4$, the present data $G_1$–$G_4$ the interpolation velocity S1–$S_4$, the start signal Cs1–Cs4 and the direction data Cm1–CM4. The data in the output-end cells of each register 46–50 are outputted to the registers and to the other circuits.

In this case, it is assumed that the registers 46–50 are in a state as shown in FIG. 8, first of all, the target data $H_1$ from the register 46 and the present data $G_1$ from the register 47 are supplied to the input-terminal A and B of the subtractor 51, respectively. The subtractor 41 calculates the level difference $D_2$ by subtracting the present data $G_1$ (in this case $H_1>G_1$) from the target data $H_1$. The level difference $D_2$ will be negative by multiplying with coefficient (–1) in the multiplier 52, and then, the result is supplied to the selector 46. In addition, in this case, the MSB bit of the level difference $D_2$ is (0).

The register 50 outputs the direction data Cm1. The direction data Cm1 is (1) because the target data $H_1$ is larger than the present data $G_2$. Thus, the select-terminal of the selector 56 and one input-terminal of the AND circuit 57 will be (0). As a result, the level difference $D_2$ is supplied to the input-terminal of the divider 58 unchanged. The interpolation velocity $S_1'$ is also supplied to the divider 58. Therefore, the divider 58 outputs the rate $R_2$, which is obtained by dividing the level difference $D_2$ by the interpolation velocity $S_1'$, to the AND circuit 63.

However, the selector 60 selects the target data $H_1$, because the select-signal CMPS which is (1), is inputted. Thus, the target data $H_1$ is supplied to the comparator 61. The comparator 61 compares the target data $H_1$ with output data of the register 65 (which data is finally present-data $G_1$ in foregoing stage), and then sets a digit (1) on the output-terminal (A>B) side. The selector 62 selects the output-terminal (A>B) side, then outputs the digit (1) to the AND circuit 63, because the direction data Cm1 is (1) in this circumstance. Furthermore, when the start signal Cs1 is supplied to the AND circuit 63, the AND circuit 63 outputs the rate $R_2$ to the adder 64. However, if the start signal Cs1 is (0), the cross-fade function (i.e. alteration of the multiple coefficient $a_1$) does not perform, the target data $G_1$ which is final data of the former stage of time sharing would be outputted as the multiple coefficient $a_1$ with uniform level.

Next, the adder 64 adds the rate $R_2$ and the output data of the register 64 (i.e. the present data $G_1$), and the result is supplied to the selector 65*a*. In this case, the selector 65*a* selects the data of the input-terminal (1) side when the start signal Cs1 is inputted, and outputs the added result of the adder 64 to the register 65. Then, the register 65 circulates data in the cells counterclockwise, and also stores the added data into the input-end cell thereof. The added data is the multiple coefficient $a_1$, and when it is moved into the output-end cell, it is supplied to the multiplier 23 (the multiplier A1).

Hereafter, the multiple coefficient generator 21 calculates the multiple coefficients $a_2$, $a_3$ and $a_4$ in each stage of time sharing while the data (the present data Gi, the target data Hi and so on) circulate in the registers 46, 47, 48, 49, 50 and 65 counterclockwise. As a result, the multiple coefficients $a_2$, $a_3$ and $a_4$ are stored into each cell of the register 65 through the selector 65*a*, sequentially, and are also supplied to the adder 23. In other words, the multiple coefficient $a_2$–$a_4$ correspond to the multipliers A1, A2, A3 and A4, respectively (see FIG. 4).

However, when the target data Hi is less than present data Gi, the direction data Cmi would be (0), so that the multiple coefficient data ai changes toward lower value, gradually. As described above, the tone waveshape data, through the DCF 20 and the multiplier 23, changes variously with time passed. The tone waveshape data is supplied to the level controller 6, and outputted as a tone signal.

As described above, the DCF controller 16*b* calculates repeatedly the cut-off frequency $f_1$–$f_4$ until they reach the target frequency $fd_1$–$f_4$, in each stage. And, whenever the $f_1 \propto f_4$ are calculated newly, they are supplied to the DCF 20. And, the calculations in the multiple coefficient generator 21 are performed repeatedly, and whenever the multiple coefficient $a_1$–$a_4$ are calculated newly, they are supplied to the multiplier 23.

However, if the result is negative in step S202, that is, if the key-on signal KON is not inputted, controls proceeds to step S213. At step S213, a test is performed to distinguish whether any key had been release by performer or not, referring to the key-off signal KOFF. If the result is positive, the control proceeds to step S214. At step S214, the keycode KC and the key-off velocity KOFFV are stored into the registers. Next, at step S216, the system controller 13 sets digit (1) on the filter designating number n. Then, the control proceeds to step S216, the designating number n is supplied to the filter system 15, that is, to the controller 16 and the multiple coefficient generator shown in FIG. 2. And, at step S217, the interpolation velocities Si and Si' are calculated on the basis of the key-off velocity KOFFV. Herein, the interpolation velocity Si in the designating number n(2) is defined as $S_2$, and Si' is defined as $S_2$. Next, at step S218, the target frequency $fd_1$, the present frequency $fn_1$ and interpolation velocity $S_1'$ are stored in each input-end cell of the registers 31, 32 and 33 in the controller 16. At step S219, the target data H1, the present data $G_1$, the interpolation velocity $S_1'$, the start signal Cs1 and the direction data Cm1 are supplied to the multiple coefficient generator 21, and then stored in each input-end cell of the registers 46, 47, 48, 49 and 50.

The control proceeds to step S220 in which the filter designating number n is incremented. Thus, the filter designating number n would be (2). Next, at step S221, a test is performed to distinguish whether the filter designating number n reaches (5) or not. In this case, since the filter designating number n is (2), the result would be negative. Therefore, the control returns to step S216, S217, S218, S219 and S220 are repeatedly performed until the result is positive at step S221. As a result, the tone information, such as the target frequency $fd_2$–$fd_4$, the present frequency $fn_2$–$fn_4$ and the interpolation velocity $S_2$–$S_4$ are supplied to the parameter controller 30, sequentially. Also, the tone information, such as the target data $H_2$–$H_4$, the present data $G_2$–$G_4$, the interpolation velocity $S_2$–$S_4$ are supplied to the multiple coefficient generator 21.

However, if the result is positive at the above-mentioned step S221, the control proceeds to step S222 in which the key-off routine is performed. The tone waveshape generator 14 generates a tone waveshape data in key-off operation. Next, the control proceeds to step S223 in which the start signal START is supplied to the timing generator 43 of the filter system 15. Finally, the control returns to the main routine shown in FIG. 9.

The DCF controller **16*b* starts calculating the cut-off frequencies $f_1$–$f_4$ in the same way as the above-mentioned key-on routine, when the start signal START is inputted thereto. The multiple coefficients $a_1$–$a_4$ corresponding with the performance of the DCF controller 16*b*. Then, the cut-off frequencies $f_1$–$f_4$ are supplied to the DCF 20, sequentially, and the multiple coefficients $a_1$–$a_4$ are supplied to the multiplier 23, sequentially. The tone waveshape data is filtered by DCF 20 which is characterized by the cut-off frequencies $f_1$–$f_4$, and then supplied to the level controller 6** to control the envelope (waveshape) thereof. Then, the tone waveshape data is outputted as the tone signal.

The described calculations are performed repeatedly and automatically until the tone waveshape data is completed, but unaccompanied by the system controller 13.

The control proceeds to step S103 shown in FIG. 9 when the control returns to the main routine of FIG. 9. At step S103, parameters are set and displayed. Then, the control returns to steps S101, S102 and S103, which are performed repeatedly.

However, in the DCF controller **16*b*, if any cut-off frequency of $f_1$–$f_4$ reaches a target frequency fd, a bit (1) is set in the cell corresponding to the filter designating number n, of the shift register 41. Whenever the calculations are finished for four stages, the contents of the shift register 41 are latched by latch circuit 42. Then, the latched data is supplied to the system controller 13 as interrupt signal Int1–Int4. The system controller 13 is interrupted with a uniform interval signal. If any interrupt is caused, a flow chart shown in FIG. 11**(*a*) and (*b*) is performed. Hereinafter, the flow chart will be described as follows.

When any interrupt is caused, first of all, control proceeds to step S301 in which a test is performed to distinguish whether any key is pressed by performer or not, by detecting the key-on signal KON. If the result is positive, control proceeds to step S302 in which key-on interrupt routine is performed.

At step S302, a test is performed to distinguish whether interrupt signal $Int_1$ is inputted or not. If the result is positive, control proceeds to step S303. At step S303, the filter designating number n is set of (1). Then, at step S304, the target frequency $fd_1$, the present frequency $fn_1$ and the interpolation velocity $S_1$ are newly supplied to the parameter controller 30, and the target data $H_1$, the present data $G_1$, the interpolation velocity $S_1'$ (which are for the multiple coefficient $a_1$), the start signal Cs1 and the direction data Cm1 are supplied to the multiple coefficient generator 21. A reset signal $IR_1$ is also supplied to the parameter controller 30 as reset signal IR.

As a result, the parameter controller 30 stores the target frequency $fd_1$, the present $fn_1$ and the interpolation velocity $s_1$ to each cell of the registers 31, 32 and 33, according to the filter designating number n, and resets the first cell (for FU1) of the latch circuit 42 by the reset signal $IR_1$. Furthermore, the Ct logic 45 stores the target data $H_1$, the present data $G_1$, the interpolation velocity $S_1'$ and the start signal Cs1 and the direction data Cm1 to each cell of the registers 46, 47, 48, 49 and 50, according to the filter designating number n.

However, if the result is negative at step S302, that is, when the interrupt signal $Int_1$ is not set, or step S304 is finished, control proceeds to step S305 in which a test is performed to distinguish whether the interrupt signal $Int_2$ is set in the latch circuit 42 or not. If the result is positive, at steps S306, the filter designating number n turns into (2). Then, at step S307, the target frequency $fd_2$, the present frequency $fn_2$, the interpolation velocity $S_2$ and the reset signal $IR_2$ are newly supplied to the parameter controller 30, and the target data $H_2$, the present data $G_2$, the interpolation velocity $S_2'$, the start signal Cs2 and the direction data Cm2 are supplied to the multiple coefficient generator 21.

As a result, the parameter controller 30 stores the target frequency $fd_2$, the present $fn_2$ and the interpolation velocity $S_2$ to each cell of the registers 31, 32 and 33, according to the filter designating number n, and resets the first cell (for FU2) of the latch circuit 42 by the reset signal $IR_2$. Furthermore, in the multiple coefficient generator 21, the CT logic 45 stores the target data $H_2$, the present data $G_2$, the interpolation velocity $S_2'$ and the start signal Cs2 and the direction data Cm2 to each cell of the registers 46, 47, 48, 49 and 50, according to the filter designating number n.

If the result is negative at step S305, that is, when the interrupt signal $Int_2$ is not set, or step S307 is finished, control proceeds to step S308 in which a test is performed to distinguish whether the interrupt signal $Int_3$ is set in the latch circuit 42 or not. If the result is positive, at step S309, the filter designating number n turns into (3). Thereafter, at step S310, the target frequency $fd_3$, the present frequency $fn_3$, the interpolation velocity $S_3$ and the reset signal $IR_3$ are newly supplied to the parameter controller 30, and are stored in each cell of the registers 31, 32 and 33, according to the filter designating number n. The third cell (for FU3) of the latch circuit 42 is reset by the reset signal $IR_3$. Furthermore, the target data $HG_3$, the present data $G_3$, the interpolation velocity $S_3'$, the start signal Cs3 and the direction data Cm3 are newly supplied to the multiple coefficient generator 21, and are stored in each cell of the registers 46, 47, 48, 49 and 50, according to the filter designating number n, as mentioned above.

If the result is negative at step S308, that is, when the interrupt signal $Int_3$ is not set, or step S310 is finished, control proceeds to step S311 in which a test is performed to distinguish whether the interrupt signal $Int_4$ is set in the latch circuit 42 or not. If the result is positive at step S311, control proceeds to step S312, the filter designating number n turns into (4). Thereafter, at step S313, the target frequency $fd_4$, the present frequency $fn_4$, the interpolation velocity $S_4$ and the reset signal $IR_4$ are newly supplied to the parameter controller 30, and stored in each cell of the registers 31, 32 and 33, according to the filter designating number n. And the fourth cell (for FU4) of the latch circuit 42 are reset by the reset signal $IR_4$. Furthermore, the target data $H_4$, the present data $G_4$, the interpolation velocity $S_4'$, the start signal Cs4 and the direction data Cm4 are newly supplied to the multiple coefficient generator 21, and are stored in each cell of the registers 46, 47, 48, 49 and 50, according to the filter designating number n.

When the result is negative at step S311, or step S313 has finished, control returns to the main routine.

While the interrupt routine is performed, the DCF controller **16*b* calculates the cut-off frequency $f_1$–$f_4$ between the present frequency $fn_1$–$fn_4$ and the target frequency $fd_1$–$fd_4$ according with the tone designating information, which is set in the interrupt routine, containing each interpolation velocity $S_1$–$S_4$. The cut-off frequency $f_1$–$f_4$ is supplied to the DCF 20 in each stage of time-sharing. Therefore, the cut-off frequency $f_1$ is supplied to the filter unit FU1, and the cut-off frequency $f_2$ is supplied to the filter unit FU2, and then the cut-off frequency $f_3$ is supplied to the filter unit FU3, further, the cut-off frequency $f_4$ is supplied to the filter unit FU4**.

In addition, the multiple coefficient generator 21 calculates the multiple coefficient $a_1$–$a_4$ between the present data $G_1$–$G_4$ and the target data $H_1$–$H_4$ according to the tone designating information, which is set in the interrupt routine, containing each interpolation velocity $S_1$–$S_4'$. The multiple coefficient $a_1$–$a_4$ are supplied to the multiplier 23 in each stage of time-sharing. Therefore, the multiple coefficient $a_1$ is supplied to the multiplier A1, and the multiple coefficient $a_2$ is supplied to the multiplier A2, and then the multiple coefficient $a_3$ is supplied to the multiplier A3, further, the multiple coefficient $a_4$ is supplied to the multiplier A4.

As a result, the tone waveshape data is filtered by the filter units FU1, FU2, FU3 and FU4 until the tone has been finished, and supplied to the level controller 6 as tone signal.

On the other hand, at step S301, if the key-off velocity KOFFV is not detected, the result would be negative, so that control proceeds to step S314. Interrupt routine of the key-off which begins from step S304 will be described as follows:

At step S314, in the same ways as the above-mentioned step S302, a test is performed to distinguish whether the interrupt signal $Int_1$ is set or not.

If the result is positive, control proceeds to step S315. At step S315, the filter designating number ns is set to (1). And then, at step S316, the target frequency $fd_1$, the present frequency $fn_1$ and the interpolation velocity $S_1$ are newly supplied to the parameter controller 30, and the target data $H_1$, the present data $G_1$, the interpolation velocity $S_1'$ which are for the multiple coefficient $a_1$, the start signal CS1 and the direction data Cm1 are supplied to the multiple coefficient generator 21. And, as a reset signal $IR_1$ is also supplied to the parameter controller 30 as reset signal IR.

As a result, the parameter controller 30 stores the target frequency $fd_1$, the present $fn_1$ and the interpolation velocity $S_1$ to each cell of the registers 31, 32 and 33, according to the filter designating number n, and resets the first cell (for FU1) of the latch circuit 42 by the reset signal $IR_1$. Furthermore, the CT logic 45 stores the target data $H_1$, the present data $G_1$, the interpolation velocity $S_1$ ' and the start signal Cs1 and the direction data Cm1 to each cell of the registers 46, 47, 48, 49 and 50, according to the filter designating number n.

However, if the result is negative at step S314, that is, when the interrupt signal $Int_1$ is not set, or step S316 has finished, control proceeds to step S317 in which a test is performed to distinguish whether the interrupt signal $Int_2$ is set in the latch circuit 42 or not. If the result is positive, at steps S318, the filter designating number n turns into (2). Then, at step S319, the target frequency $fd_2$, the present frequency $fn_2$, the interpolation velocity $S_2$ and the reset signal $IR_2$ are newly supplied to the parameter controller 30, and also stored in each cell of the register 31, 32 and 33, according to the filter designating number n. The first cell (for FU2) of the latch circuit 42 is reset by the reset signal $IR_2$. The target data $H_2$, the present data $G_2$, the interpolation velocity $S_2'$, the start signal Cs2 and the direction data Cm2 are supplied to the multiple coefficient generator 21, and also supplied to each cell of the registers 46, 47, 48, 49 and 50, according to the filter designating number n.

If the result is negative at step S317, that is, when the interrupt signal $Int_2$ is not set, or step S319 has finished, control proceeds to step S320 in which a test is performed to distinguish whether the interrupt signal $Int_3$ is set in the latch circuit 42 or not. If the result is positive, at step S321, the filter designating number n turns into (3). Thereafter, at step S322, the target frequency $fd_3$, the present frequency $fn_3$, the interpolation velocity $S_3$ and the reset signal $IR_3$ are newly supplied to the parameter controller 30, and are stored in each cell of the registers 31, 32 and 33, according to the filter designating number n. And the third cell (for FU3) of the latch circuit 42 are reset by the reset signal $IR_3$. Furthermore, the target data $H_3$, the present data $G_3$, the interpolation velocity $S_3'$, the start signal Cs3 and the direction data Cm3 are newly supplied to the multiple coefficient generator 21, and are stored in each cell of the registers 46, 47, 48, 49 and 50, according to the filter designating number n, as the mentioned above.

If the result is negative at step S320, that is, when the interrupt signal $Int_3$ is not set, or step S322 has finished, control proceeds to step S323 in which a test is performed to distinguish whether the interrupt signal $Int_4$ is set in the latch circuit 42 or not. If the result is positive, at step S324, the filter designating number n turns into (4). Thereafter, at step S313, the target frequency $fd_4$, the present frequency $fn_4$, the interpolation velocity $S_4$ and the reset signal $IR_4$ are newly supplied to the parameter controller 30, and stored in each cell of the registers 31, 32 and 33, according to the filter designating number n. The fourth cell (for FU4) of the latch circuit is reset by the reset signal $IR_4$. Furthermore, the target data $H_4$, the present data $G_4$, the interpolation velocity $S_4'$, the start signal Cs4 and the direction data Cm4 are newly supplied to the multiple coefficient generator 21, and are stored in each cell of the registers 46, 47, 48, 49 and 50, according to the filter designating number n.

When the result is negative at step S323, or step S325 has finished, control returns to the main routine.

As described above, while the cut-off frequency $f_1$–$f_4$ is calculated repeatedly, if any cut-off frequency f reaches to the target frequency fd, either of key-on routine or key-off routine is performed. In key-on routine, any step S316, S319, S322 and S325 is performed according to the interrupt signal $Int_1$–$Int_4$. If any step S316, S319, S322 and S325 is performed, the DCF controller **16*b* calculates the cut-off frequencies $f_1$–$f_4$ by linear supplement technique between the present frequencies $fn_1$–$fn_4$ and the target frequencies $fd_1$–$fd_4$ in accordance with interpolation velocities $S_1$–$S_4$ continuously. Each cut-off frequency $f_1$, $f_2$, $f_3$ and $f_4$ is supplied to the DCF 20, i.e., FU1, FU2, FU3 and FU4, respectively. Next, the multiple coefficient generator 21 calculates the multiple coefficients $a_1$–$a_4$ by linear supplement technique between the present data $G_1$–$G_4$ and the target data $H_1$–$H_4$ in accordance with interpolation velocities $S_1'$–$S_4'$, continuously. Each multiple coefficient $a_1$, $a_2$, $a_3$ and $a_4$ is supplied to the multiplier 23, i.e., A1, A2, A3 and A4**, respectively.

As a result, the tone waveshape data is filtered by the multiple filter units FU1–FU4, and then supplied to the level controller 6. Thereafter, the tone waveshape data is outputted as tone waveshape signal.

Figure 12:
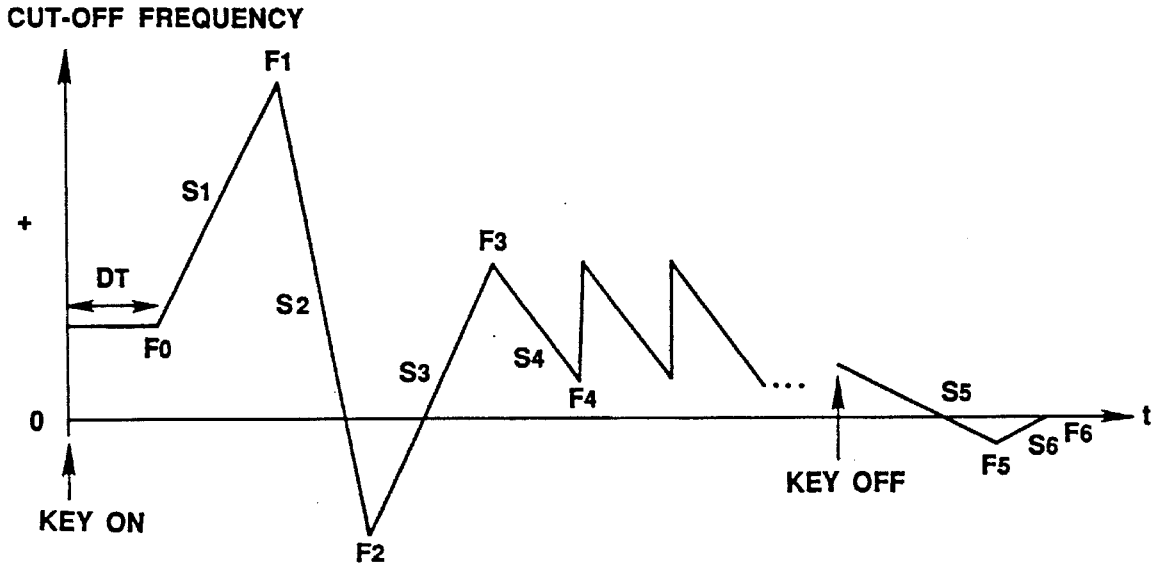
FIG. 12 is a waveform diagram showing an example of a cut-off frequency $f_1$ in the embodiment.

Herein, for example, the cut-off frequency $f_1$ for filter until FU1 is shown in FIG. 12. In FIG. 12, the target frequency $fd_1$ which is set in first stage, is designated as $F_1$, and the present frequency $fn_1$ which is set in first stage, is designated as $F_0$, further, the interpolation velocity Si is designated as $S_1$. When the cut-off frequency f reaches the target frequency $F_1$, the target frequency fd is set to target frequency $F_2$, and the present frequency fn is set to $F_1$ which is former target frequency fd, further, the interpolation velocity Si is set to $S_2$. Thereafter, the target frequency fd is set for $F_3$, $F_4$, . . . , one after another. The present frequency fn is set to $F_2$, $F_3$, . . . , and the interpolation velocity Si is set to $S_3$, $S_4$, . . . , one after another. Thus, the cut-off frequency f is changed with time passed. In this case, the target frequency fd is set to $F_3$ and $F_4$ repeatedly until the key-off signal KOFF is inputted. Thereafter, in key-off stages, the target frequency fd is set to $F_6$, and the present frequency fn is set to $F_5$, further, the interpolation velocity Si is set to $S_6$, respectively. As a result, the cut-off frequency f for filter unit FU1 is changed with time passed as shown in FIG. 11. However, each cut-off frequency $f_2$, $f_3$ and $f_4$ for filter unit FU2, FU3 and FU4, respectively, is changed with time passed as mentioned above.

Figure 13:
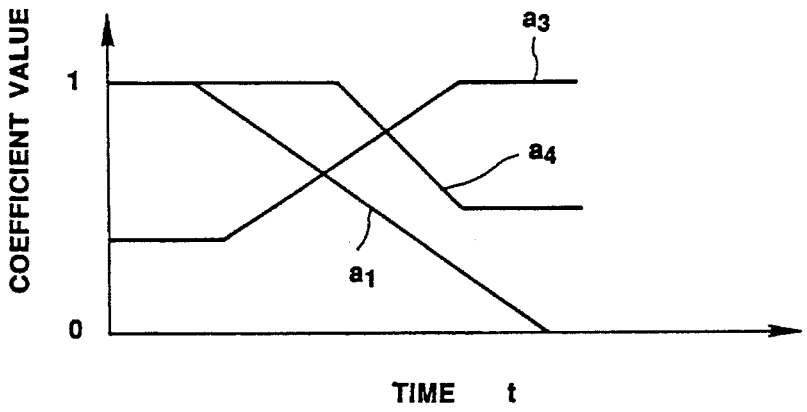
FIG. 13 is a waveform diagram showing an example of multiple coefficients $a_1$, $a_2$, $a_3$ and $a_4$ in the embodiment.

Herein, these coefficients $a_1$–$a_4$, for example, are shown in FIG. 13. In this FIG. 13, the coefficients $a_1$–$a_4$ are changed with time passed, however, their set-values and inclinations may be changed in accordance with tone designating information (as key touch pressure).

A least coefficient $a_1$, $a_2$, $a_3$ and $a_4$ from the multiple coefficient generator 21 may be a fixed value. In addition, the techniques of conventional envelope generator are self-evident to apply in the means which changes coefficients $a_1$–$a_4$. Furthermore, signals in accordance with various operation by performer may be applied as coefficients $a_1$–$a_4$.

In an acoustic piano, when a key-release occurs, a damper presses a string of the released key, and then vibration of the string is stopped by the damper. Thus, the musical tone of the released key fades out. Herein, a faster velocity of the key-release, results in the damper pressing the string sooner, so that the string vibration is damped rapidly. At this time of the tone color, the faster the velocity of the key-release, the faster the tone color in the interval from a start of the key-release to a no-sound state is changed. Moreover, a harmonic overtone which contains high frequencies is decreased rapidly. Therefore, in this embodiment, if the apparatus simulates the key-release in the acoustic piano more accurately, the cut-off frequency f of the DCF 20 may be decreased with velocity which is accord with key-release velocity of the acoustic piano.

Furthermore, in this embodiment, the cut-off frequency f and the multiple coefficient ai are calculated by simple liner interpolation technique, they may also be calculated by another interpolation techniques using various curves, for example, an index curve. According to this technique, it is possible to provide various tone color, not only piano sound.

As a result, according to this modified example, it is possible to obtain the musical tone without expanding and complicating the apparatus. In addition, it is possible to obtain musical tone having great variety whose tone color can be varied smoothly.

What is claimed is:

1. An electronic musical instrument which generates musical tones based on performance information, comprising:

(a) musical tone source means for generating tone waveshape data defining musical tones according to the performance information;

(b) parameter generator means for generating a plurality of time varying parameters, based on said performance information, as control signals; and (c) parameter control means for receiving the generated musical tones from said musical tone source means, said parameter control means including a plurality of filter units having filtering coefficients which are freely and separately controllable, and filter forming means for forming an interconnection of the plurality of filter units to process the musical tones from the tone source means, the parameter control means changing an output level of at least one of said plurality of interconnected filter units by performing interpolation responsive to a speed corresponding to the performance information so as to change a tone color of a musical tone.

2. An electronic musical instrument in accordance with claim 1, wherein said parameter generator means outputs said plurality of time varying parameters in a manner such that successive time varying parameters change over time from arbitrary predetermined values to target values.

3. A musical tone generating apparatus in accordance with claim 1 further comprising mixing means for mixing outputs of said plurality of units.

4. An electronic musical instrument according to claim 1, wherein said parameter control means utilizes said plurality of filter units in a time sharing manner.

5. An electronic musical instrument according to claim 4, wherein said tone color controlling parameter is a cut-off frequency of at least one of said plurality of filter units.

6. An electronic musical instrument according to claim 1, further including register means for storing an output signal from at least one of said plurality of filter units.

7. An electronic musical instrument according to claim 1, wherein said parameter control means controls said filter forming means to produce a plurality of filter interconnections between selected ones of said plurality of filter units in accordance with said performance information, thereby producing a filter configuration having a desired filter characteristic.

8. An electronic musical instrument according to claim 1, further including at least one multiplying means, operatively connected with an output of one of said plurality of filter units, for multiplying a signal output from said one filter unit, said multiplying means being provided with a time varying multiplier coefficient, thereby producing a time varying multiplied signal.

9. An electronic musical instrument according to claim 1, wherein a cutoff frequency of at least one of the plurality of filter units is changed from a present value to a target value by performing interpolation responsive to a speed corresponding to a touch.

10. An electronic musical instrument according to claim 9, wherein the touch is a velocity at a key-on event.

11. An electronic musical instrument according to claim 9, wherein the touch is a velocity at a key-off event.

12. A filter system for an electronic musical instrument comprising:

means for receiving a musical tone information input signal;

filtering means for filtering said musical tone information input signal and for producing a filtered musical tone signal output;

parameter generating means for generating a parameter used for controlling characteristics of the filtering means; and controlling means for providing a tone color controlling parameter to said filtering means by an interpolation operation which utilizes a predetermined value for said tone color controlling parameter and a present value for said tone color controlling parameter to set a changing rate of said controlling parameter, said changing rate being determined in response to a touch of a performer, and said controlling means being capable of changing said changing rate in a lapse of time, thus changing a cut-off frequency of said filtering means over time to produce a musical tone signal having a desired waveshape;

wherein said system is controlled in a time-shared manner, said filtering means performing plural filtering operations over time so as to operate as a plurality of filters for filtering a musical tone signal and said parameter controls an output level of at least one of said plural filtering operations of the filtering means to thereby control tone color of a musical tone.

13. A filter apparatus for an electronic keyboard musical instrument having a plurality of keys comprising:

musical tone source means for generating musical tones according to the depression and release of selective keys;

key velocity measuring means for determining the velocity of key depression and release of said selectively depressed keys;

parameter generator means for generating control signal parameters dependent upon said key velocity measured by said key velocity measuring means, said control signal parameters being generated in accordance with an interpolation operation based on said key velocity and being variable over time; and parameter control means for changing at least one parameter which characterizes tone color of said musical tones in accordance with said time variable control signal parameters, said parameter control means including filtering means having a plurality of filters for filtering a musical tone signal, filter forming means for forming a selectable interconnection of said plurality of filters, and output control means for selectively changing the output level of at least one of said plurality of interconnected filters depending on said control signal parameters.

14. A filter apparatus in accordance with claim 13, wherein said parameter generator means generates plural control signal parameters and said parameter control means includes plural filtering means which are capable of being arbitrarily interconnected, said musical tone being filtered in said plural filtering means depending on said plural control signal parameters to thereby output filtered tone signals having different tone colors.

15. A filter apparatus in accordance with claim 14, wherein said parameter generator means outputs control signal parameters which change with time from arbitrary values to target values.

16. A filter apparatus for an electronic keyboard musical instrument according to claim 13, wherein at least one of said plurality of filters is selectively controllable to comprise one of a high-pass filter and a low-pass filter.

* * * * *